United States Patent [19]

Fraioli

[11] Patent Number: 4,550,533

[45] Date of Patent: Nov. 5, 1985

[54] AIR-SUPPORTED STRUCTURE FOR SPORT ACTIVITIES

[76] Inventor: Donato M. Fraioli, 884 Palmer Ave., Mamaroneck, N.Y. 10543

[21] Appl. No.: 431,553

[22] Filed: Sep. 30, 1982

[51] Int. Cl.[4] ..... E04B 1/345

[52] U.S. Cl. ..... 52/2; 52/80

[58] Field of Search ..... 52/2, 80

[56] References Cited

U.S. PATENT DOCUMENTS

| | | | |
|---|---|---|---|
| 3,710,519 | 1/1973 | Jones | 52/2 |
| 3,728,831 | 4/1973 | Bird | 52/2 |
| 3,893,268 | 7/1975 | Bird | 52/2 |
| 3,924,363 | 12/1975 | Candle | 52/2 |
| 4,188,756 | 2/1980 | Ljungbo | 52/2 X |
| 4,192,105 | 3/1980 | Morgan | 52/2 |
| 4,307,554 | 12/1981 | Morrison et al. | 52/2 |

FOREIGN PATENT DOCUMENTS

| | | | |
|---|---|---|---|
| 2447562 | 4/1976 | Fed. Rep. of Germany | 52/2 |
| 2509495 | 9/1976 | Fed. Rep. of Germany | 52/2 |

*Primary Examiner*—J. Karl Bell

*Attorney, Agent, or Firm*—Robert T. Burns; Emmanuel J. Lobato; Bruce L. Adams

[57] ABSTRACT

An air-supported structure for housing sport activities such as a golf-driving range. The structure is made of a substantially air-impervious membrane and preferably enclosed in a cable net. The structure is provided with an internal system of protective deflectors to protect the structure membrane from driven golf balls to avoid damage therefrom. An additional air-supported structure is attached to the main golf-range structure for housing therein club facilities such as a bar.

20 Claims, 41 Drawing Figures

AIR-SUPPORTED STRUCTURE FOR SPORT ACTIVITIES

This invention relates generally to air-supported structures and more particularly to an air-supported structure constructed and contoured for housing sport activities such as a golf-driving range and the like.

Air-supported structures have been known for many years. They are smoothly contoured or are a convoluted fabric shell which is shaped and stabilized as a body of revolution about a single axis. Basic designs have been made and are in the form of spherical, cylindrical or combined shapes or with some minor variation of circular elements. These structures have different types of ends and different height profiles.

Non-standard shapes combining different shapes and various cross sections exceeding one-half of a circle or being only a portion of a circle, require special engineering consideration. Special care has to be taken in designing the envelope or shell of such structures to insure that loadings will be balanced and controlled so as to limit stress concentrations in the structure. A well-constructed air-supported structure is generally smoothly contoured and when inflated or fully pressurized, the structure develops the proper pattern for loading and uniform stress and distribution.

There are several typical basic designs. For example, a spherical shape, a cylindrical shape with spherical ends, and a cylindrical shape with cylindrical ends.

Air-supported structures must provide the maximum resistance possible to aerodynamic wind loads which impose substantially high stresses on the fabric. The stresses are dependent or are a function of the inflation pressure, the design wind load and the radius of the building. For this reason, adequate and proper envelope design is essential to insure that the envelope will safely and reliably meet specified strength requirements.

These envelopes should be designed for an inflation pressure of 1.5 inches water, gauge pressure. They should be able to withstand wind loads of over 80 mph. and satisfy local codes and have a safety factor of 4.0.

In recent years these air-supported structures provide temporary enclosure for industrial, military and social use.

Air-supported structures are made of a space-enclosing membrane anchored to the ground or base on which they are mounted and are kept in tension by internal air pressure at a sufficient pressure that it can support applied loads. These are to be distinguished from air-inflated structures which consist of self-enclosed membranes inflated with air to form a stiff structural member capable of transmitting applied loads to its point of support. For this latter type of structure high and low pressure systems exist. Also air-control structures are known. Such a structure is one whose position or movement is achieved through pressure differential.

Air-supported structures may be cable reinforced. The membrane or shell is anchored to a base with an air seal. Entrances are made with minimum air leakage.

With cable-reinforced air-supported structures, the membrane is enclosed in a cable net. The membrane distributes the load locally to the cables which transfer the loads to the base anchorage. The internal air pressure must be such as to make the air structure rigid to resist external pressure from wind or snow. Maintenance of this internal air pressure is constant and is produced by fans which have sufficient capacity.

Standby pressure-maintaining equipment is provided in case of a temporary failure.

There is a certain degree of loss of air, and therefore pressure, through the membrane, and ventilators and around the perimeter and at the doors. The loss and the desired air pressure and volume of the envelope or shell determine the fan capacity.

SUMMARY OF THE INVENTION

An air structure according to the invention has a flexible sheet made of a plurality of panels made, for example, of a flexible reinforced plastic material. The air supported structure is anchored around its base perimeter and air is introduced by inflation fans. The air supports the complete structure flexible envelope. Within the air-supported structure, sports activities for example, a golf driving range and the like, may be disposed. The structure in an air-supported condition has a longitudinal profile in which the rear end of the structure is substantially higher than a front end thereof. The top of the structure extends upwardly from the front toward the rear at a substantial pitch along the major length of the structure to a substantially highest portion of the structure and rapidly curves downwardly at the rear toward its anchor area or base.

The structure has in plan a substantially truncated triangular configuration at the periphery where it is anchored to its base with substantially a straight rearend at the anchor area and a substantially straight front end at the base or anchoring area with arcuate or rounded corners. The structure has transverse elevation profiles with a substantially arcuate upwardly convex central area surface with symmetrical arcuate wing surface areas extending laterally therefrom and curving downwardly toward the anchorage area surface.

DESCRIPTION OF THE PREFERRED EMBODIMENTS

Figure 1:
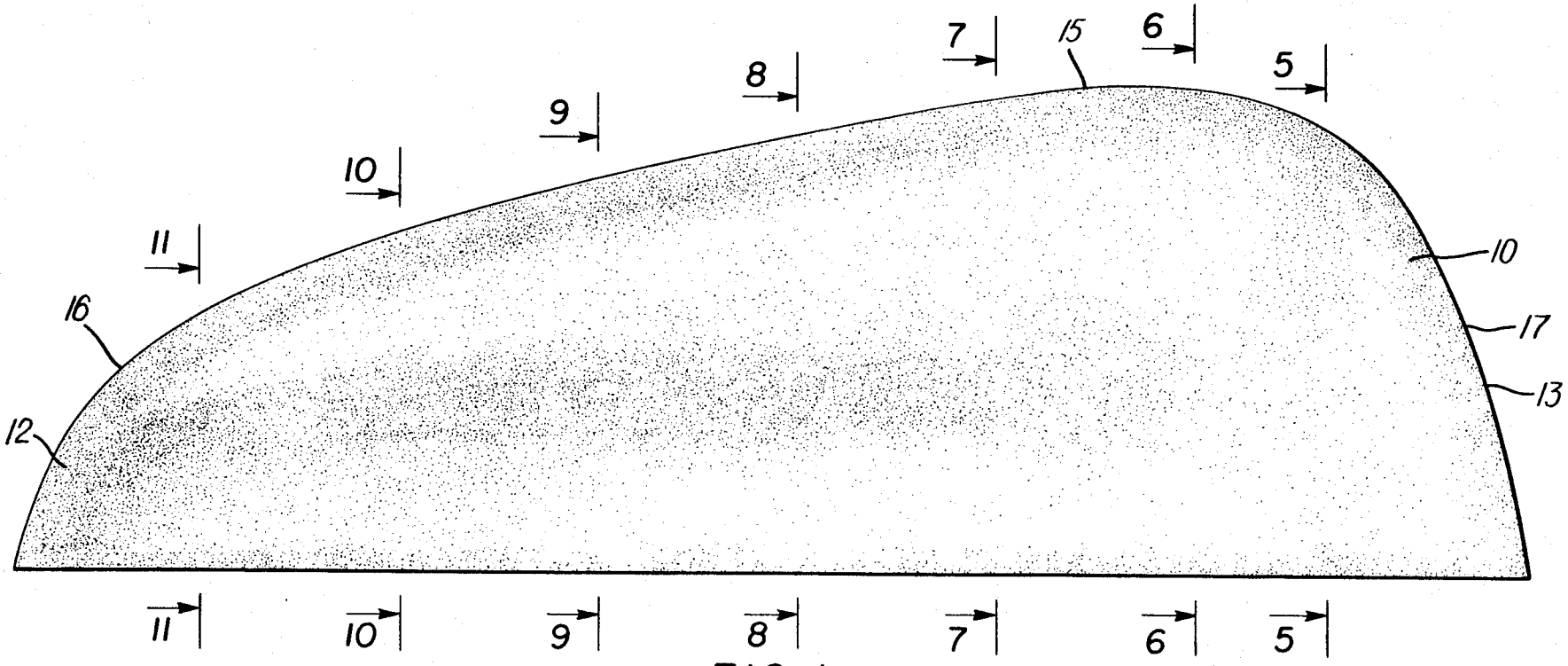
FIG. 1 is an elevation profile or side elevation view of an air-supported structure according to the invention.

Air-supported structures according to the invention comprise a membrane 10 made of a flexible sheet of a plurality of panels of a flexible reinforced plastic material. The panels can be made of different shapes in known manner and are not illustrated in the drawings. The air-supported structure is illustrated in an inflated condition and has a front or forward end 12 and a rear end 13. The elevation profile reaches its highest peak at a point 15 closer to the rear 13 than to the front 12 of the air-supported structure.

Figure 2:
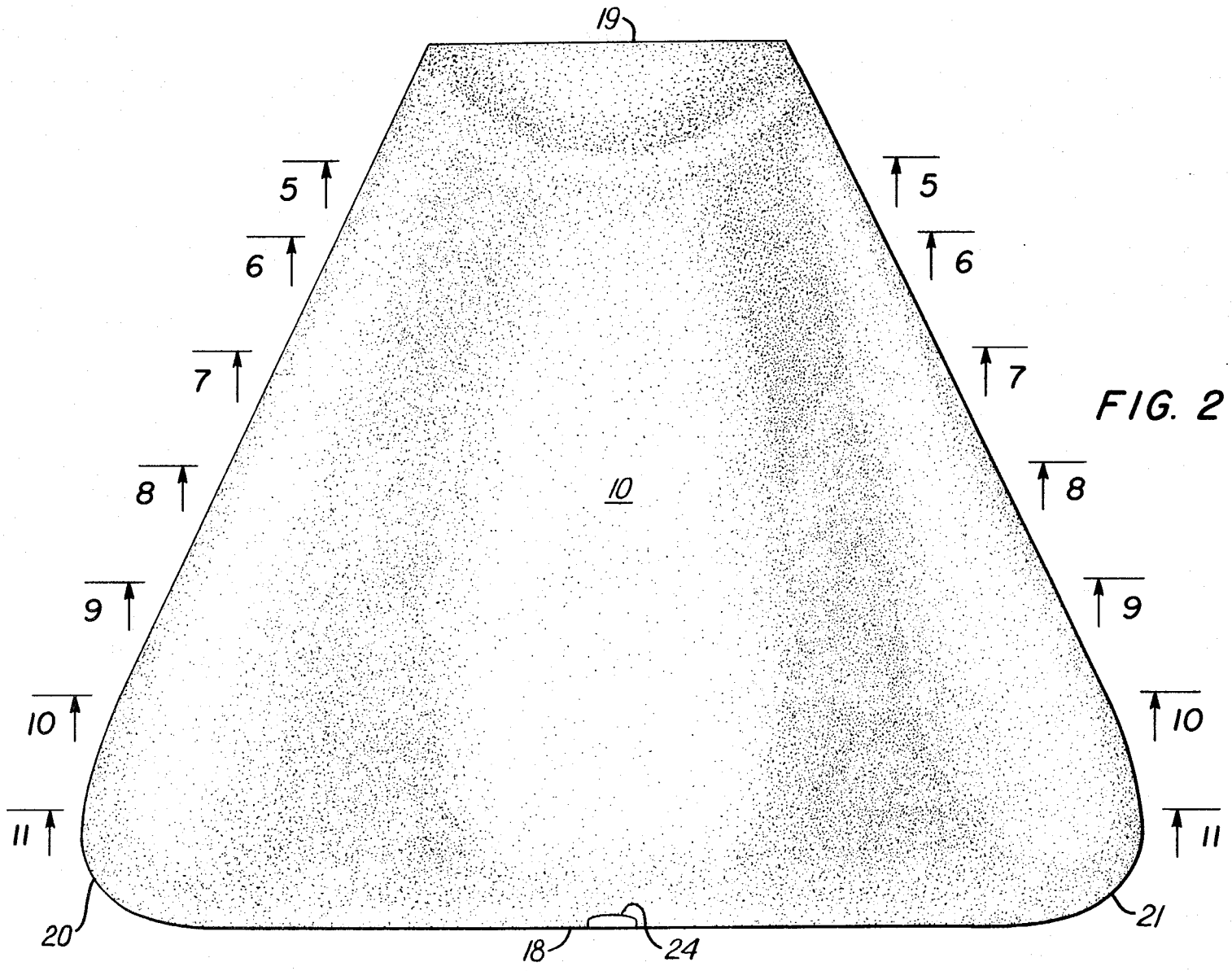
FIG. 2 is a plan view of the air-supported structure in FIG. 1.

As can be seen in FIG. 1, the side elevation profile is arcuate and rises along a front end portion 16 and then slopes toward the rear and drops rapidly in the rear portion 17. The air-supported structure is illustrated in plan in FIG. 2. The forward end is flat at the peripheral edge 18 where anchorage is effected and the rear peripheral edge 19 is likewise flat so that the structure in plan is a substantially triangular or the configuration of a truncated triangle with rounded front end corners 20, 21.

Figure 3:
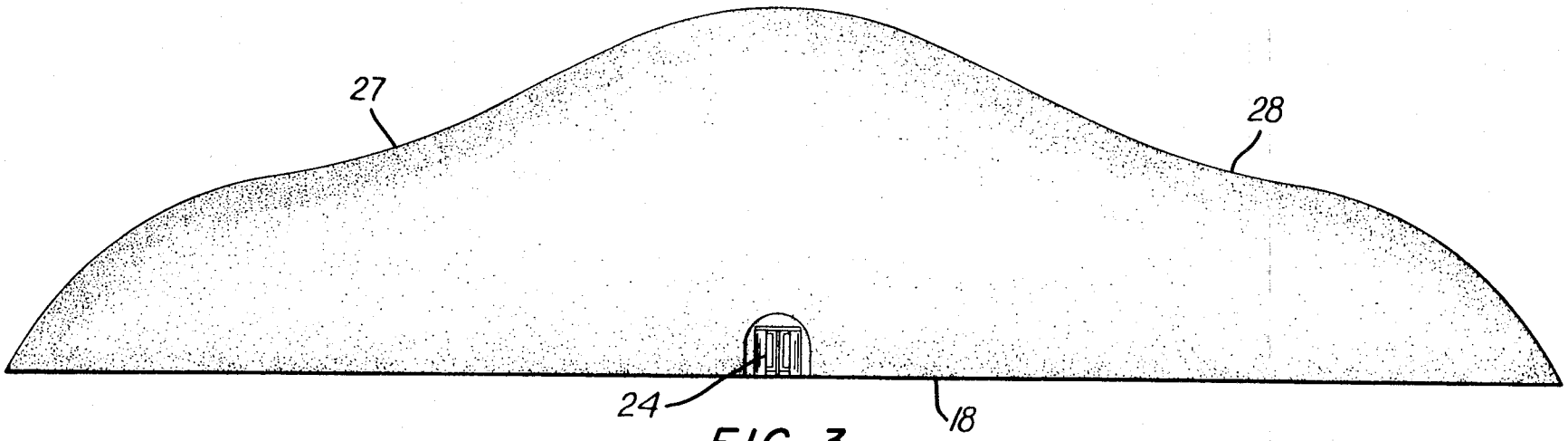
FIG. 3 is a front end elevation view of the air-supported structure in FIG. 1.
Figure 4:
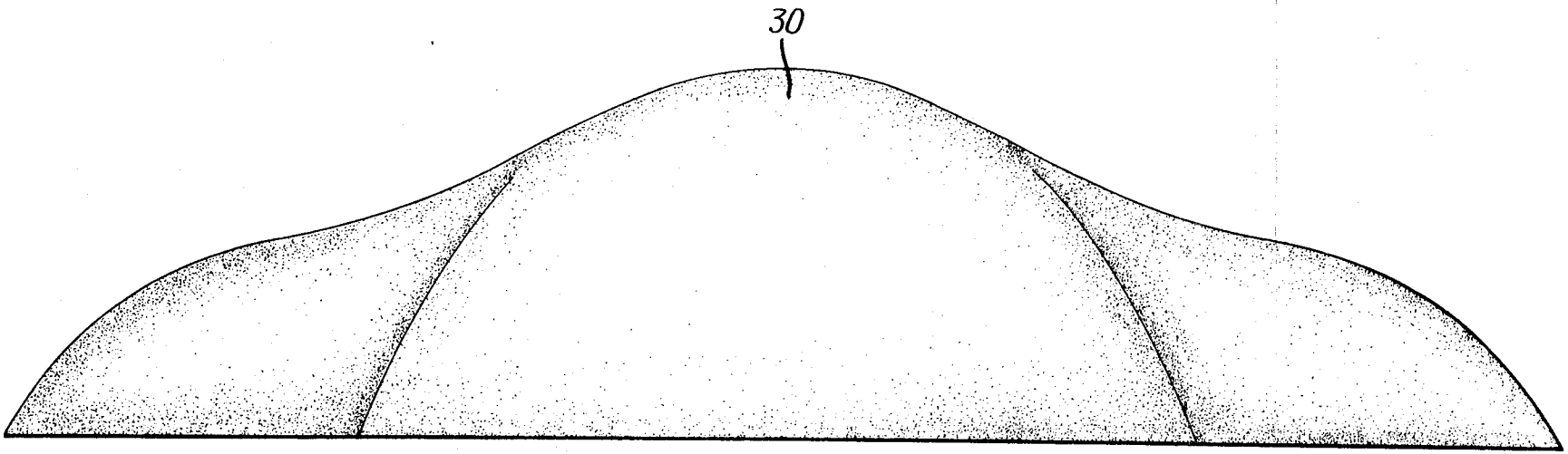
FIG. 4 is a rear end elevation view of the air-supported structure in FIG. 3.
Figure 5:
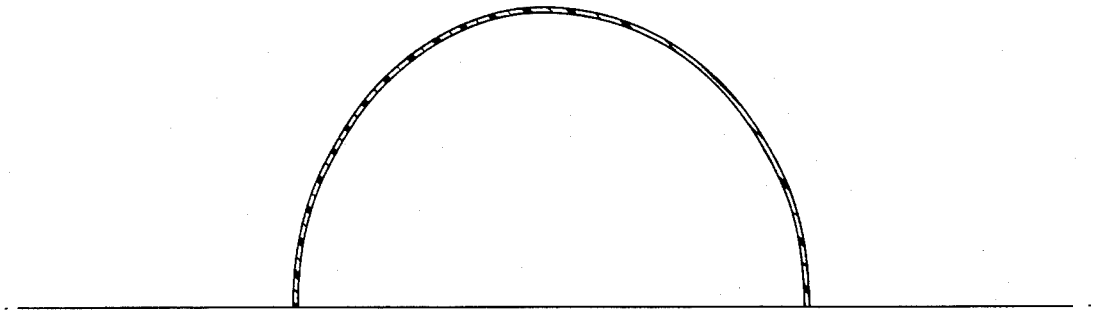
FIGS. 5–11 inclusive, are views illustrating the cross section elevation profiles of each cross section illustrated in FIG. 1.
Figure 6:
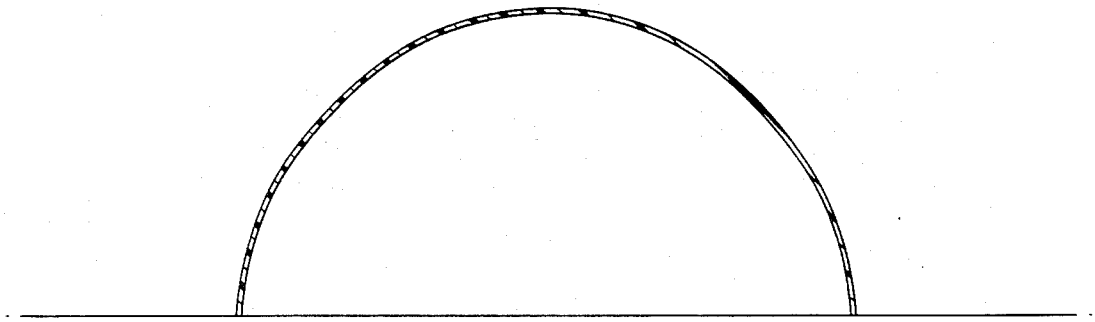
Figure 7:
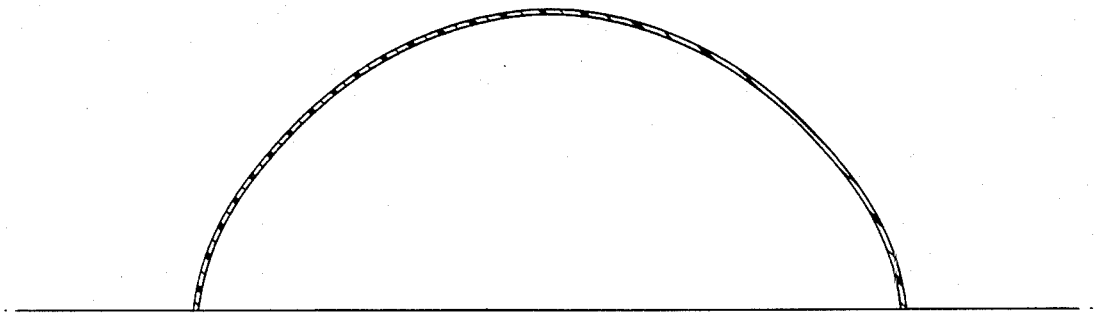
Figure 8:
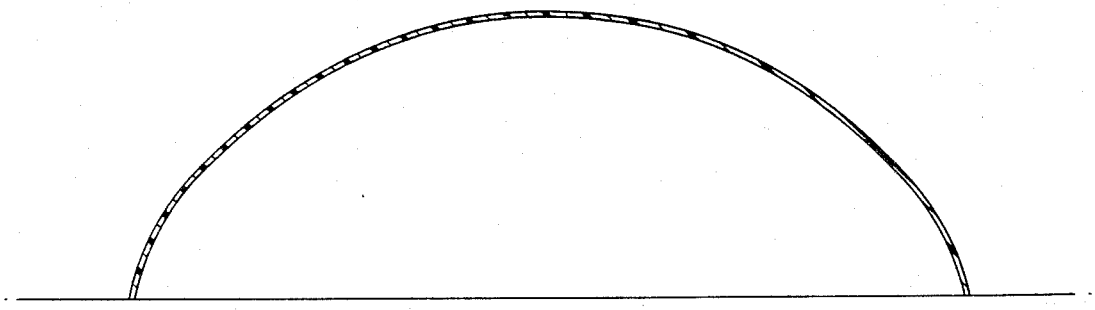
Figure 9:
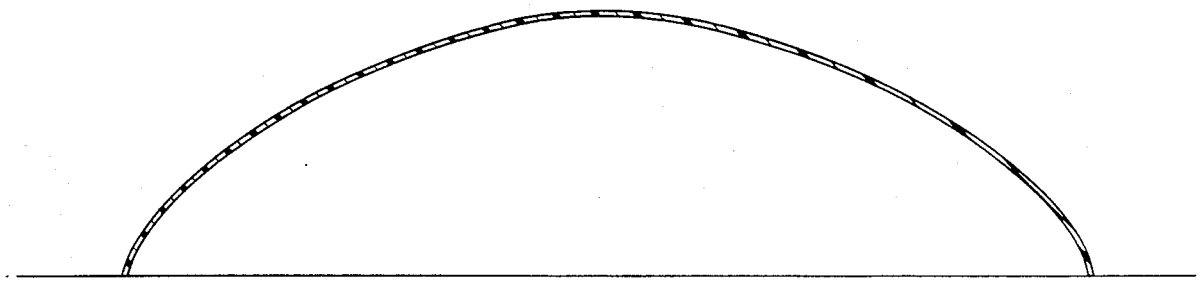
Figure 10:
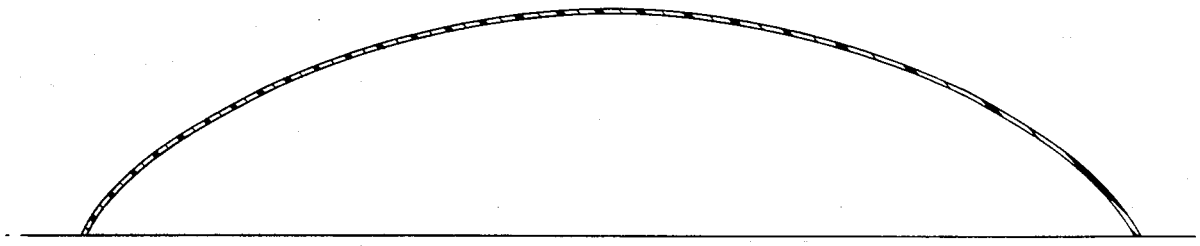
Figure 11:
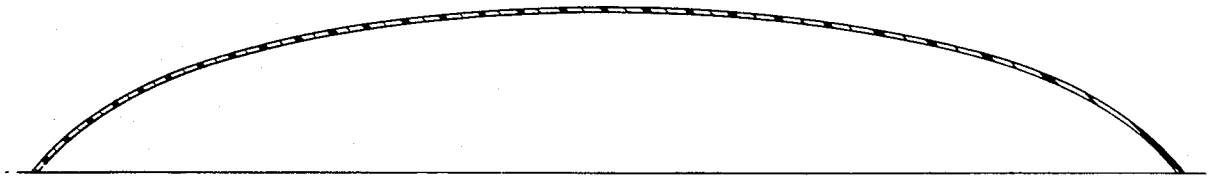

The air-supported structure is provided with an air lock type door 24 of the known type that permits entry without loss of air pressure within the structure. The structure when inflated has lateral wings 27, 28 symmetrically about a vertical plane passing through the longitudinal axis as shown in FIG. 3. The rear of the air-supported structure shown in FIG. 4 has a generally spherical rear end 30.

The transverse cross-section profiles of the air-supported structure change substantially as illustrated in FIGS. 5–11 inclusively. As can be seen, the rear end of the building is substantially cylindrical in cross section and the diameter of the profiles changes as illustrated in FIGS. 5–11 inclusive. Toward the front end of the structure, the wings 27, 28 assume a much less arcuate configuration as illustrated in FIGS. 5–11 inclusive and flatten out.

The smooth curved surfaces of the structure are intended to provide a structure that has excellent aerodynamic characteristics and is able to withstand high wind and snow loading. The air-supported structure is constructed with the wings as illustrated providing ample lateral width for a broad front for having a plurality of driving stations of a driving range enclosed within the air-supported structure.

The air structure is made of a membrane of sheet material which is a multi-layer ply. The outer layer is vinyl and is laminated or coated over nylon or polyester or other structural fibers. The top coating can be of various surface coatings such as "Polymeric" or "Tedlar" to keep the surface clean and abrasive resistant. The fabric is engineered to produce high translucent light spectrums so grass can grow within the structure and at the same time eliminate the need of artificial lighting in day time. Opaque plastic is also available when desired.

Figures 12, 13, 14:
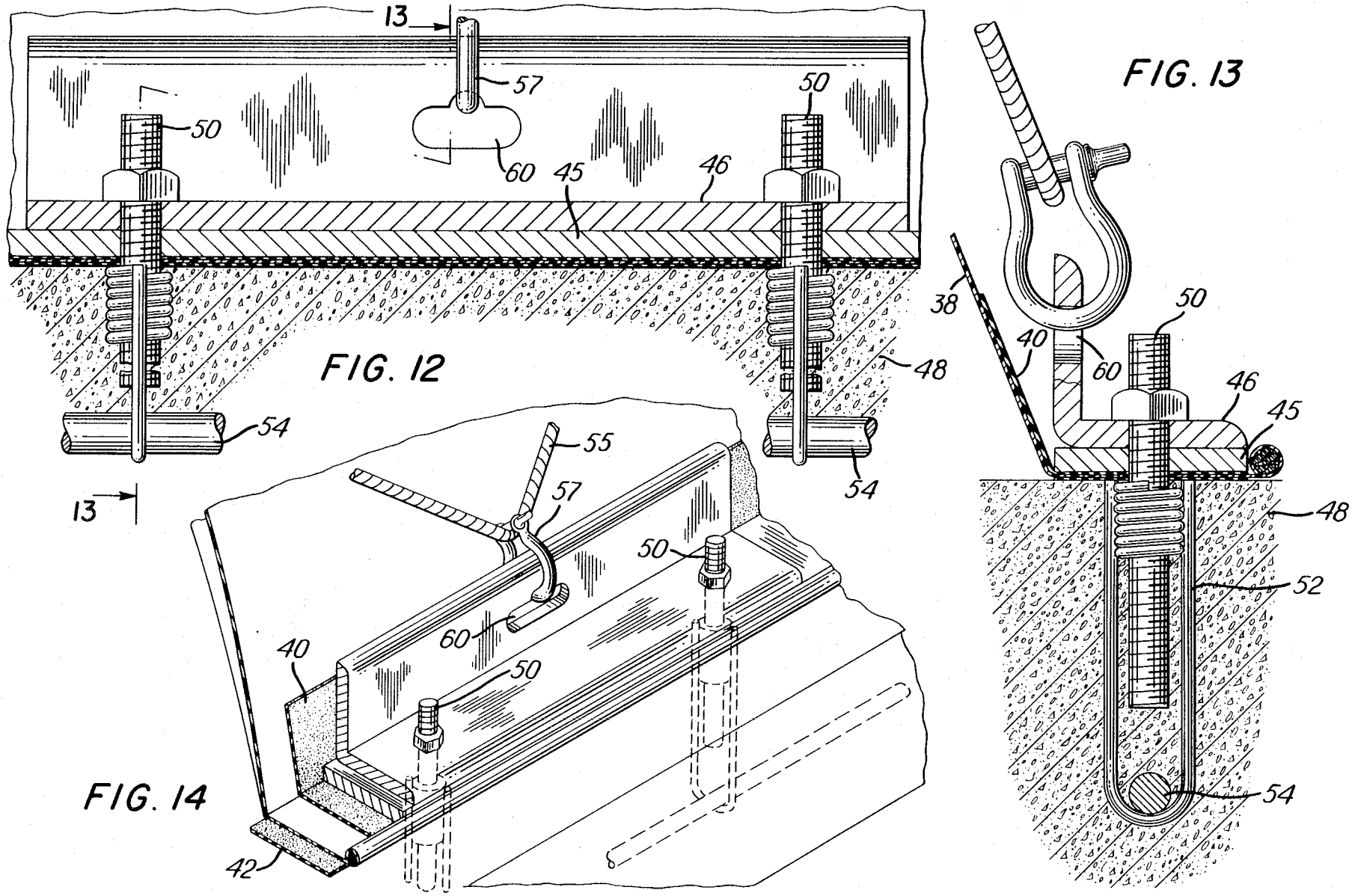
FIG. 12 a fragmentary perspective view illustrating the anchorage system for the air-supported structure in FIG. 1.
FIG. 13 is a cross section view taken at section line 13—13 of FIG. 12.
FIG. 14 is a fragmentary perspective view of the anchor arrangement of FIG. 12 and 13 for an air-supported structure according to the invention.
Figure 15:
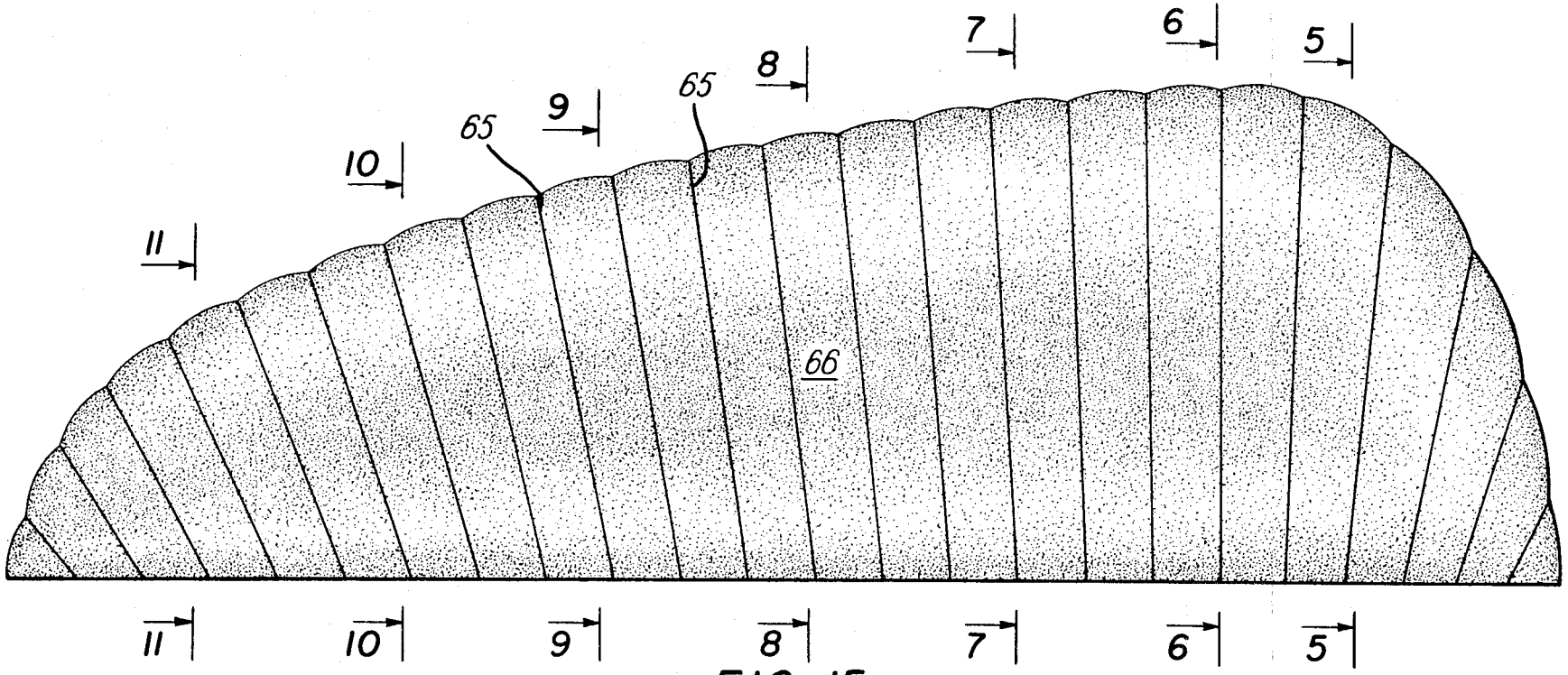
FIG. 15 is a side elevation view of another embodiment of an air-supported structure according to the invention.
Figure 16:
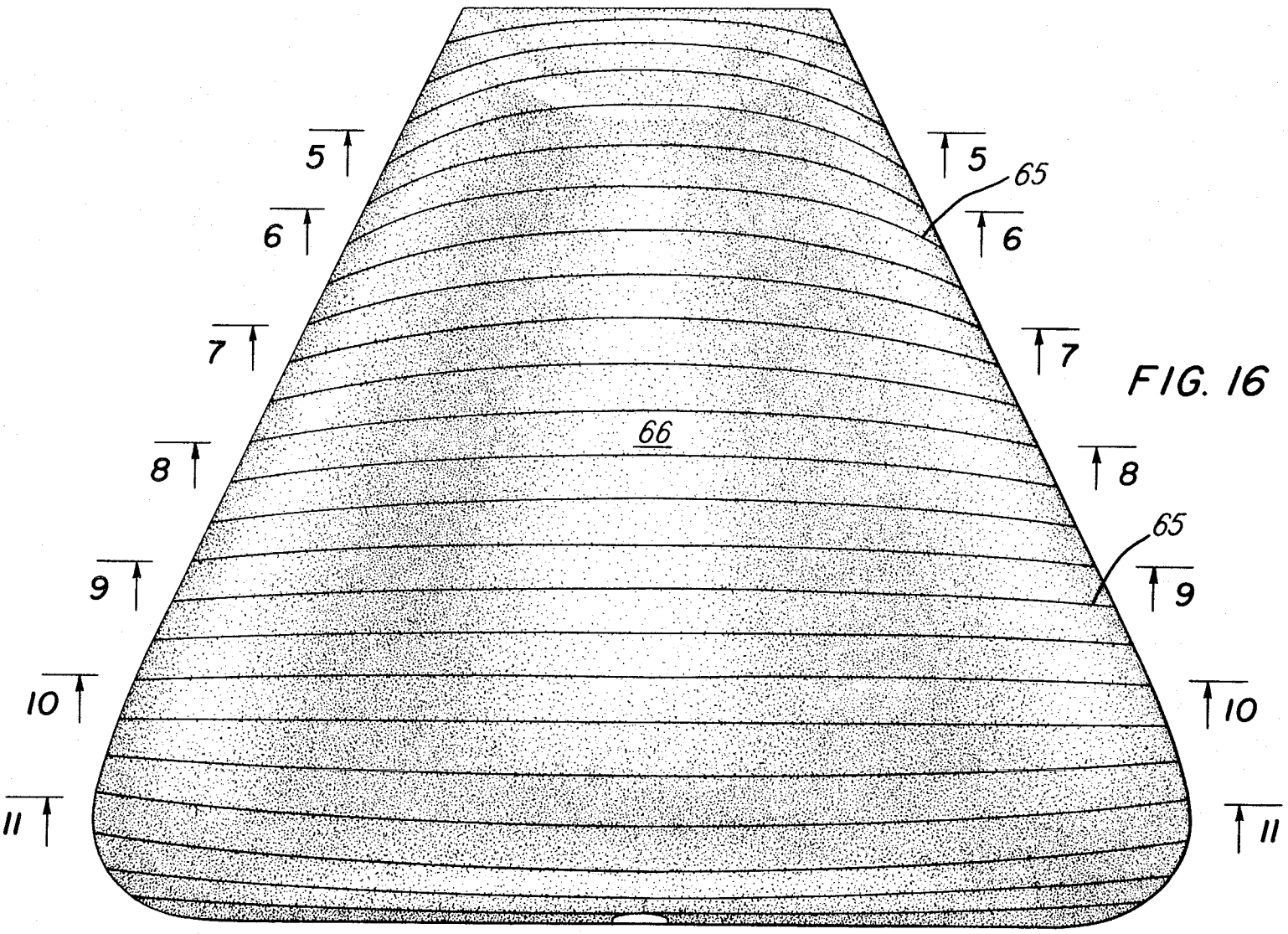
FIG. 16 is a plan view of the air-supported structure in FIG. 15.
Figure 17:
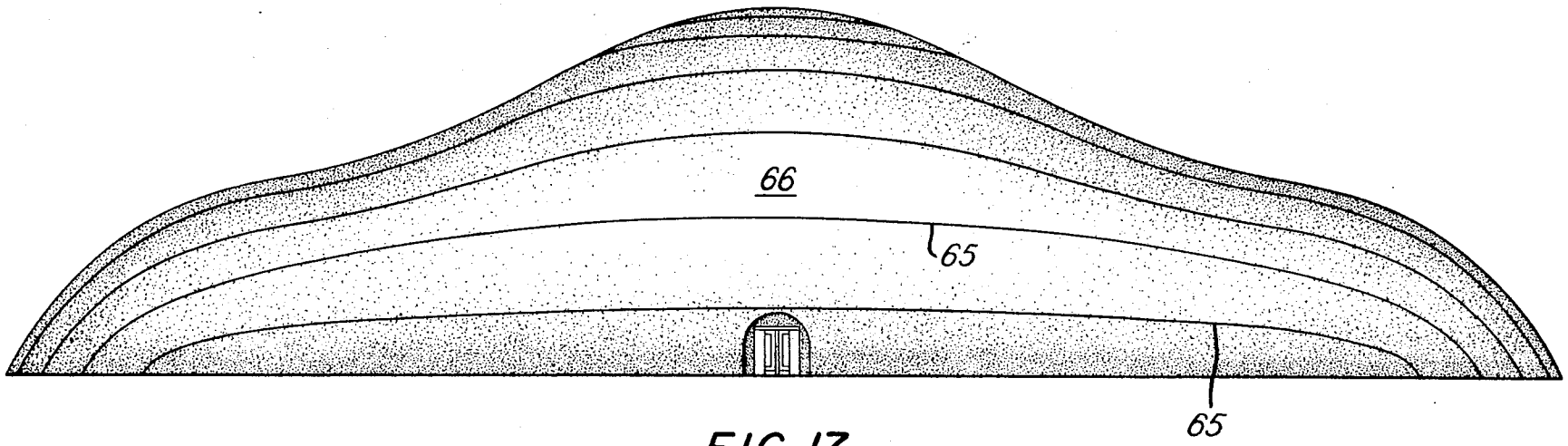
FIG. 17 is an elevation view of a front end of the air-supported structured in FIG. 16.
Figure 18:
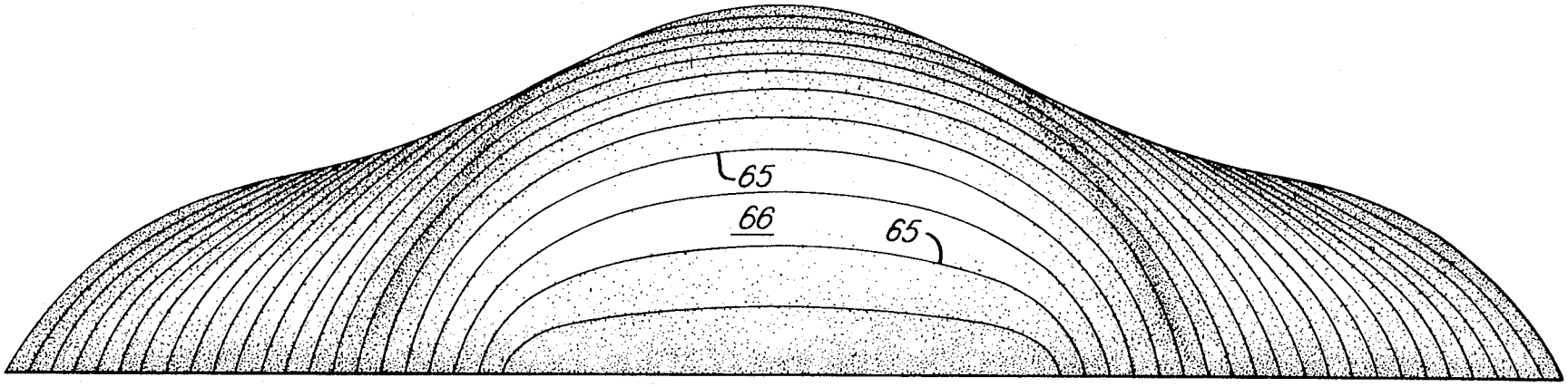
FIG. 18 is an elevation of a rear end of the air-supported structure in FIG. 17.
Figure 19:
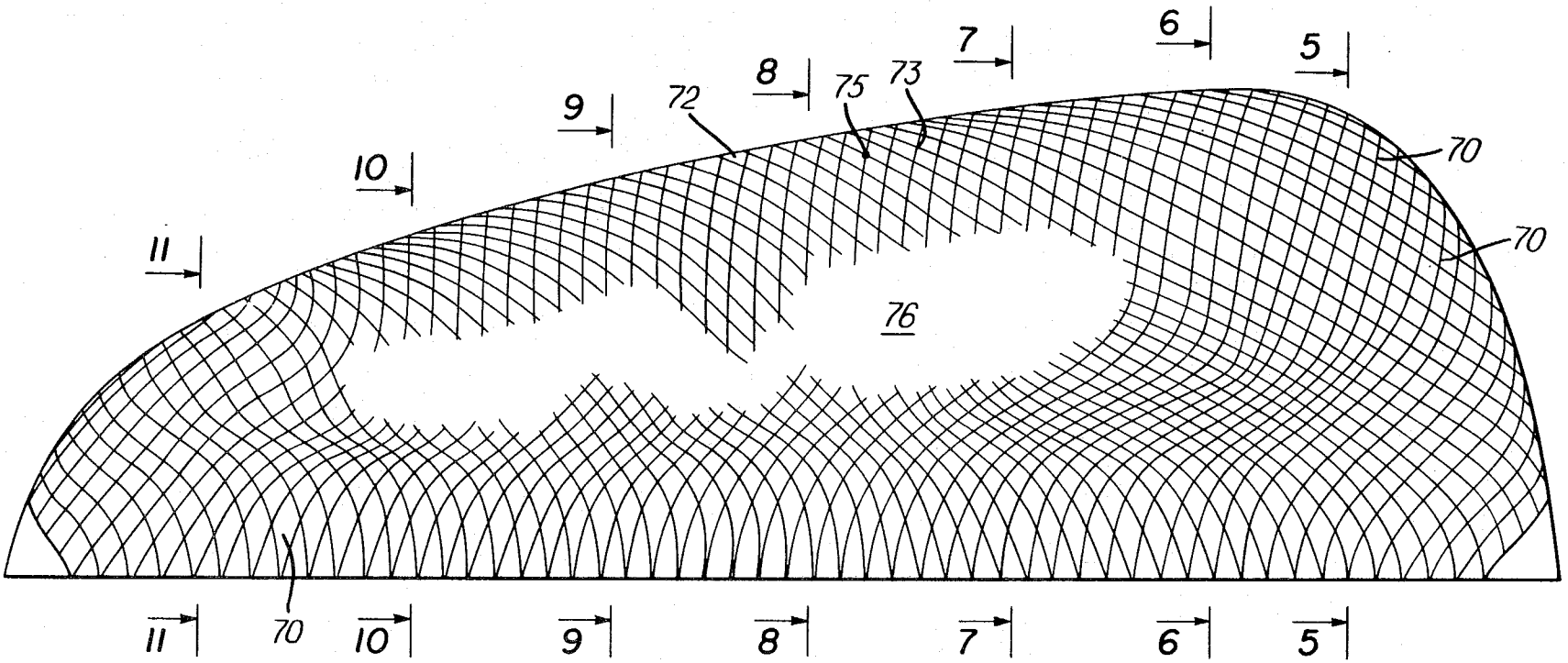
FIG. 19 is a side elevation view of another embodiment of an air-supported structure according to the invention.
Figure 20:
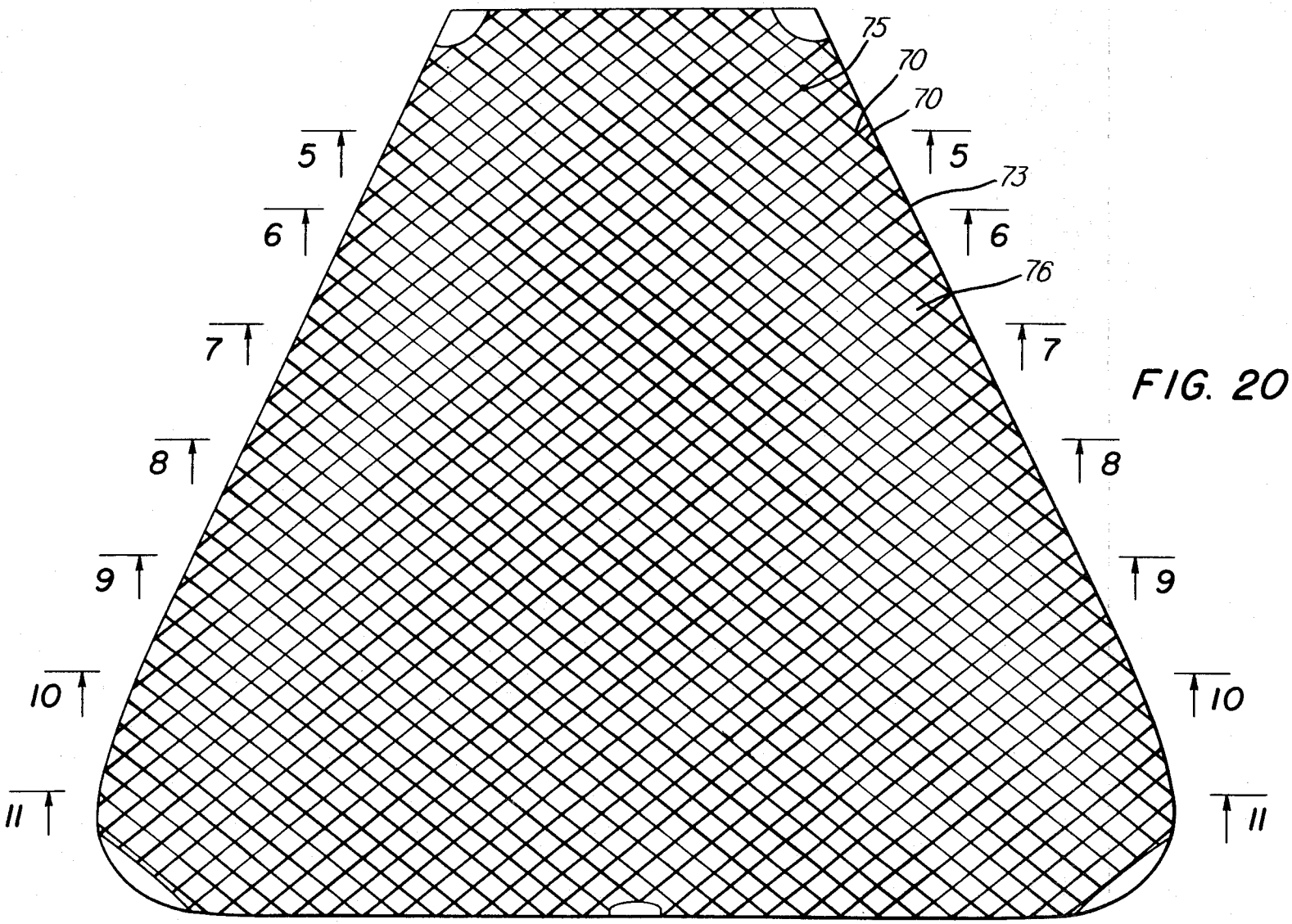
FIG. 20 a plan view of the air-supported structure in FIG. 19.
Figure 21:
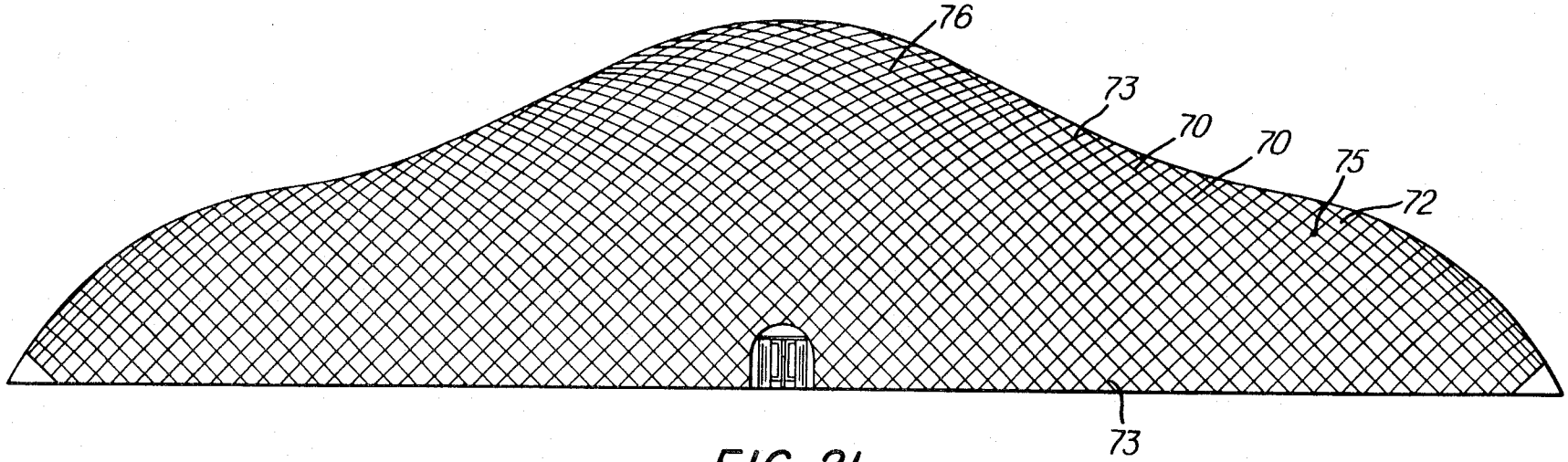
FIG. 21 is an elevation view of a front end of the air-supported structure in FIG. 19.
Figure 22:
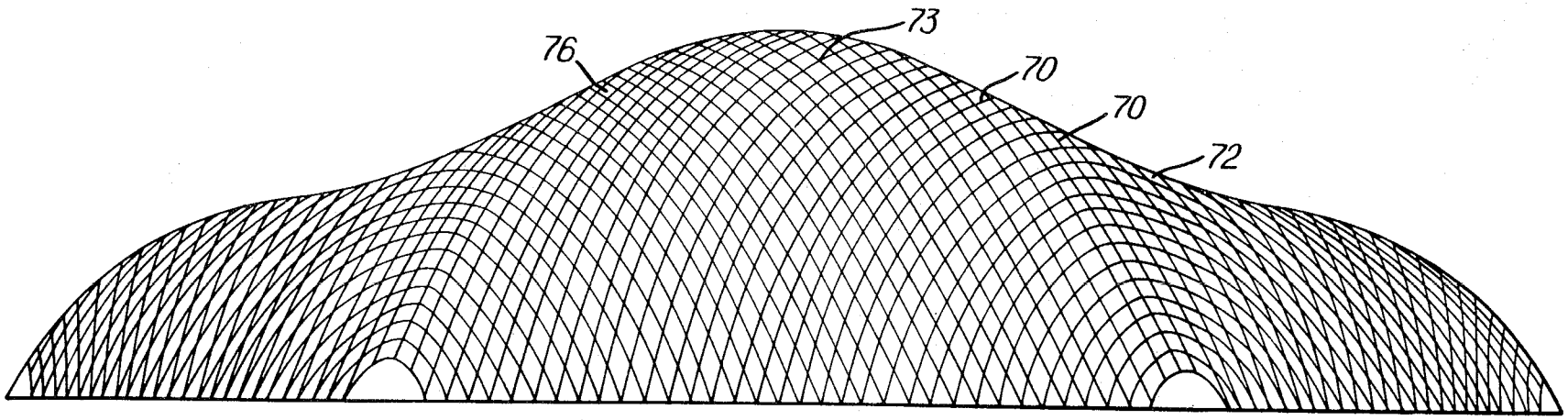
FIG. 22 is an elevation view of a rear end of the air-supported structure in FIG. 19.
Figure 23:
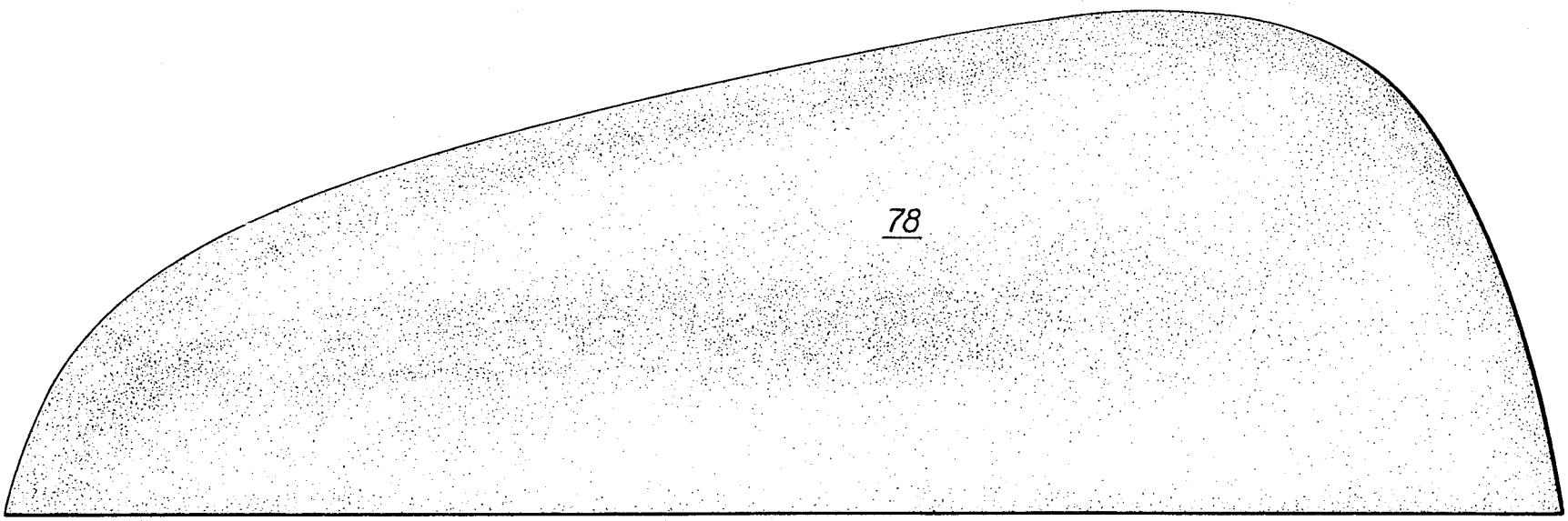
FIG. 23 is a side elevation view of an air-supported structure according to the invention.

The sheet material 38 illustrated in FIG. 13, as a single ply, is a multilayer material as before described. A runner 40 of the material is bonded to the lower edges of the air-supported structure and a gasket strip 42 are clamped between a metal clamping strip 45 anchored the air-supported structure on a concrete base 48. Anchor bolts 50 are embedded in concrete within a U-shaped anchor 52 anchored within the concrete base by reinforcing rods 54. A plurality of these anchor bolts and angle irons are disposed along the base of the envelope to rigidly anchor the air-supported structure to the concrete base.

Provision is made for the use of a cable net or harness 55 shown fragmentarily and the different types thereof are discussed later herein. The cable net is anchored by use of clevises 57 passing through longitudinal slots 60 in the angle irons. The cable and attachment to the anchorage will depend on site conditions.

The principal or main air-supported structure illustrated in the drawings and embodiments hereinafter later described, have a side elevation profile and transverse cross sections or profiles at different points the same as the heretofore described embodiment in FIG. 1.

Accordingly, the cross section views of each embodiment are not illustrated.

The invention makes provision for the use of one non-stress relief system and two types of cable nets or networks. The stress relief systems are preferably metal cables—but in some installations, flexible webbing can be used. One type of net comprises parallel cables 65 distributed along the axial length of the air-supported structure 66 as illustrated in FIGS. 15–18 inclusive. These cables are spaced at suitable axial distances apart along the length of the air-supported structure and are anchored by anchors similar to those disclosed in FIGS. 12–14 inclusive except that the individual cables do not pass through a clevise of the type shown in FIG. 14 but are secured to the anchor angle plates by a suitable eye, not shown.

The cable net may also be made with a plurality of intersecting metallic cables or webbing straps 70 which intersect in the manner illustrated in FIGS. 19–22 inclusive. These cables or webbing straps intersect and define diamond-shaped square or trapezoid spaces 72 between the intersecting cables or web straps. At the points of intersection 73, the cables are tied together at each point of intersection. For example, the intersections at each apex 73 of a diamond-shaped square or trapezoid space is provided with a cable tie holding the cables in fixed relative assembly with respect to their points of intersection. These cable ties may be of different types. Cable ties can be made as solid bodies 75 of a fusible material, for example, lead, can be moulded around the two intersecting cables to make a fixed relative tie therebetween. Only some are shown. The individual cables or webbing straps overlie the air-supported structure 76 and are anchored in the manner illustrated in FIGS. 12–14.

Figure 24:
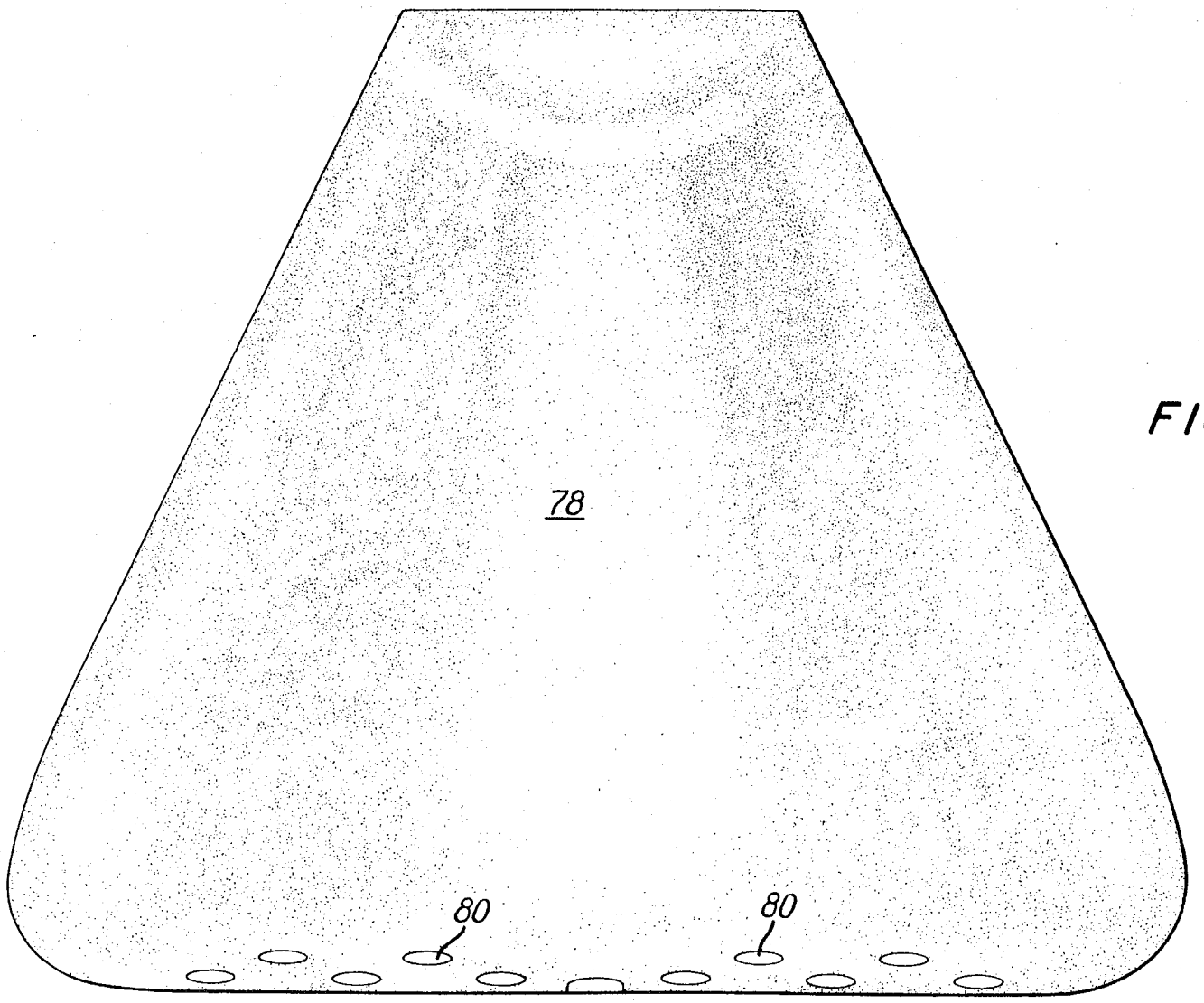
FIG. 24 is a plan view of the air-supported structure in FIG. 22.
Figure 25:
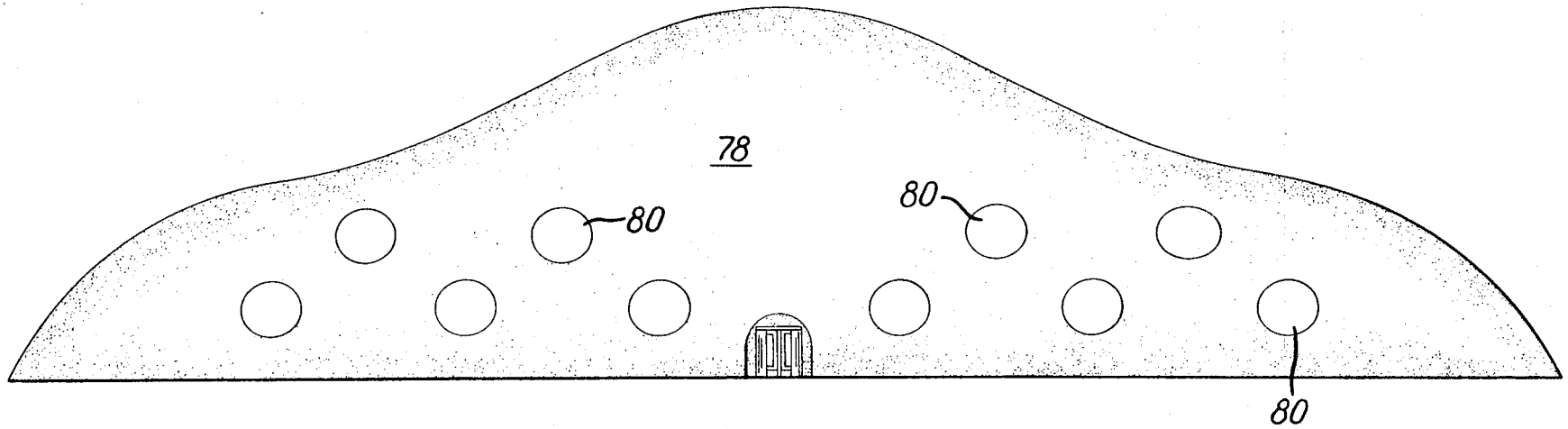
FIG. 25 is an elevation view of a front end of the air-supported structure in FIG. 23.
Figure 26:
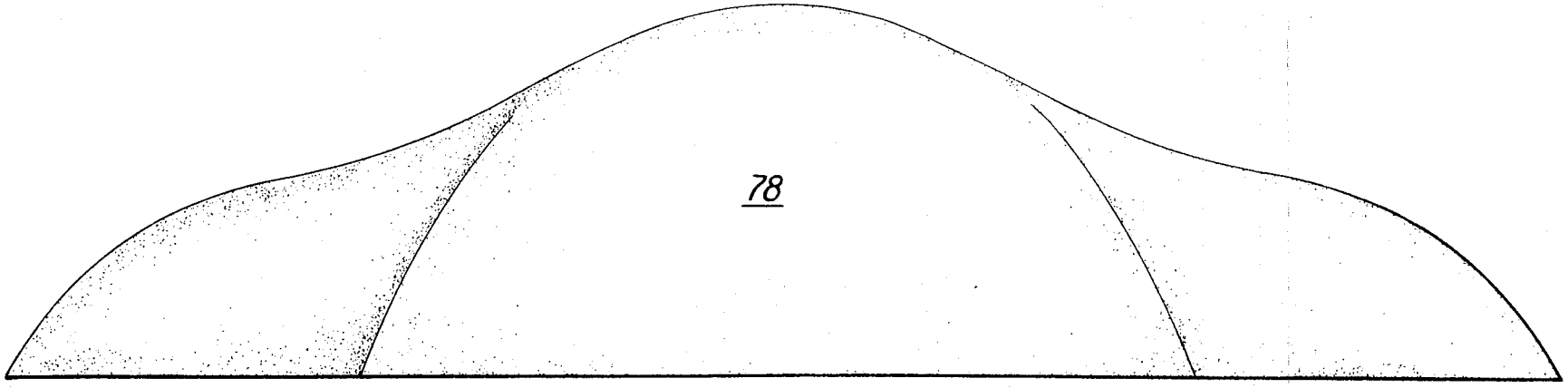
FIG. 26 is an elevation view of the air-supported structure in FIG. 23.
Figure 27:
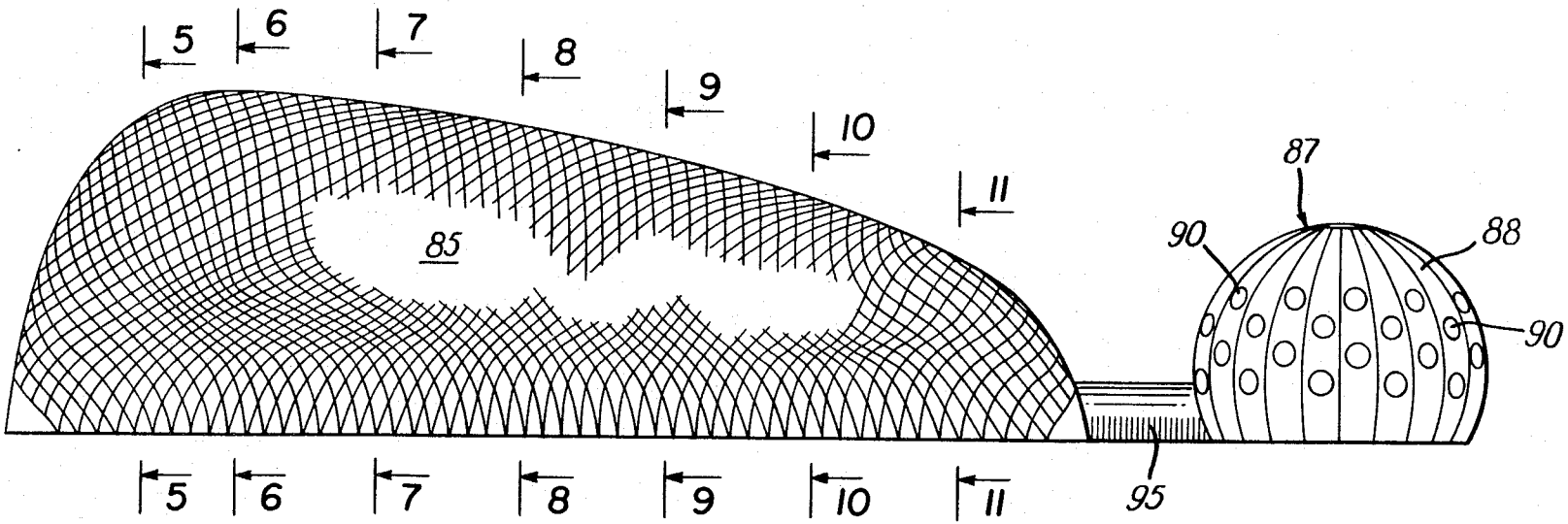
FIG. 27 is a side elevation view of an arrangement or combination of air-supported structures according to the invention.
Figure 28:
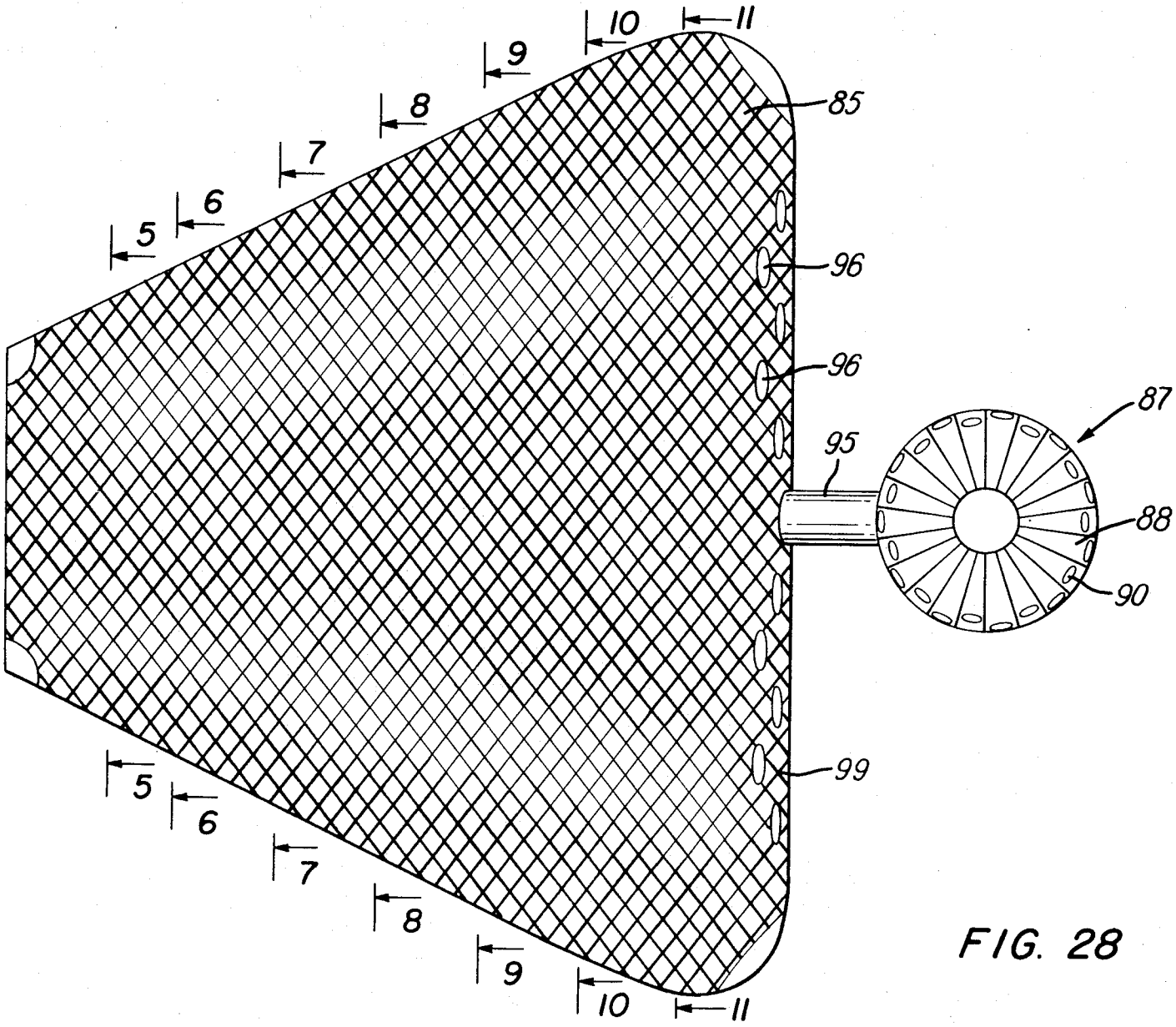
FIG. 28 is a plan view of the arrangement of air-supported structures in FIG. 27.
Figure 29:
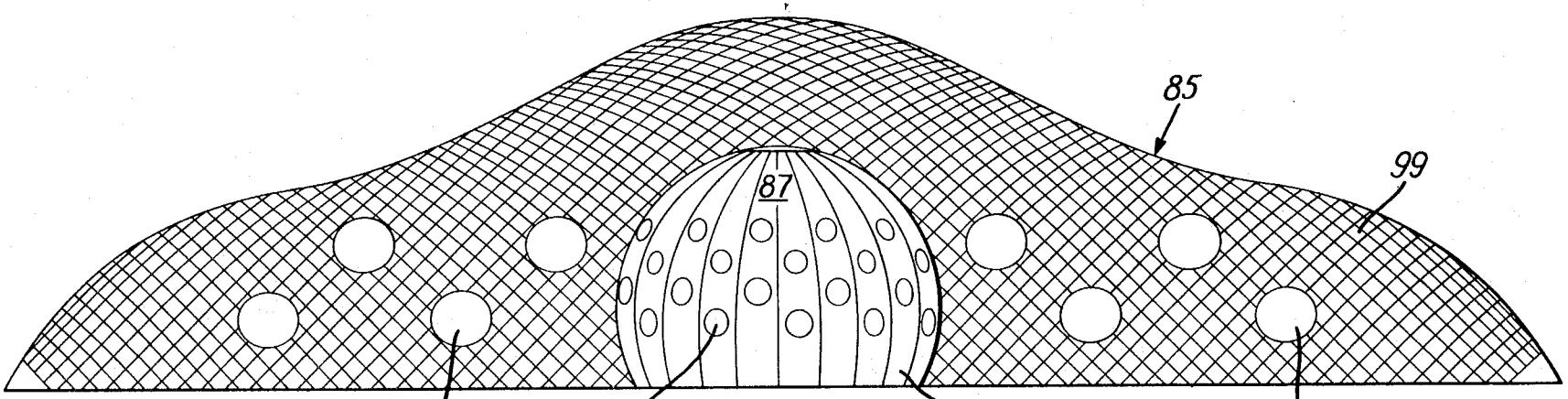
FIG. 29 is an elevation view of a front end of the arrangement of air-supported structures of FIG. 27.
Figure 30:
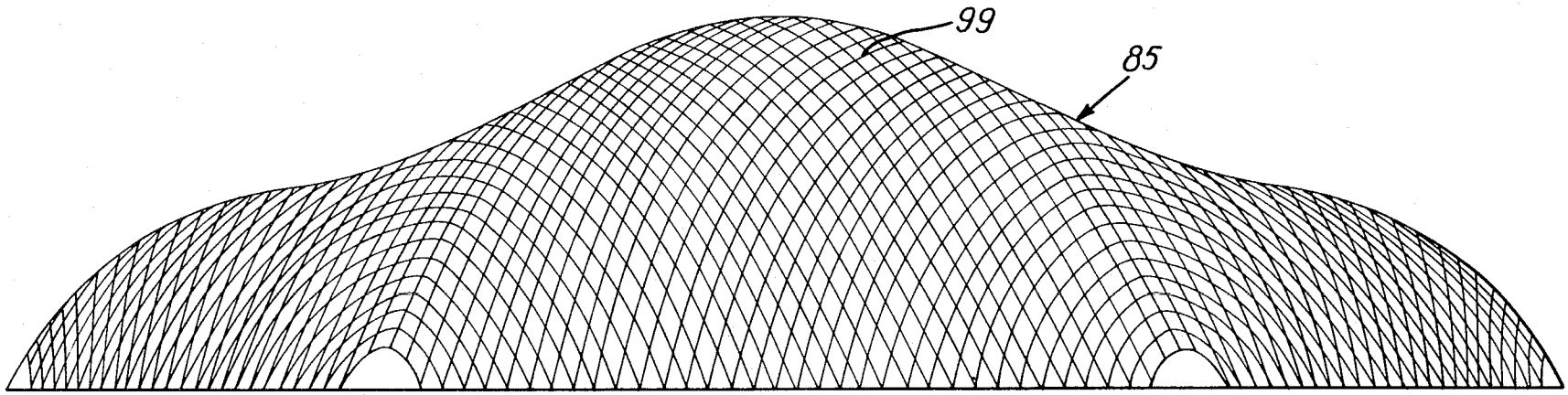
FIG. 30 is an elevation view of a rear end of the arrangement of the air-supported structures of FIG. 27.
Figure 31:
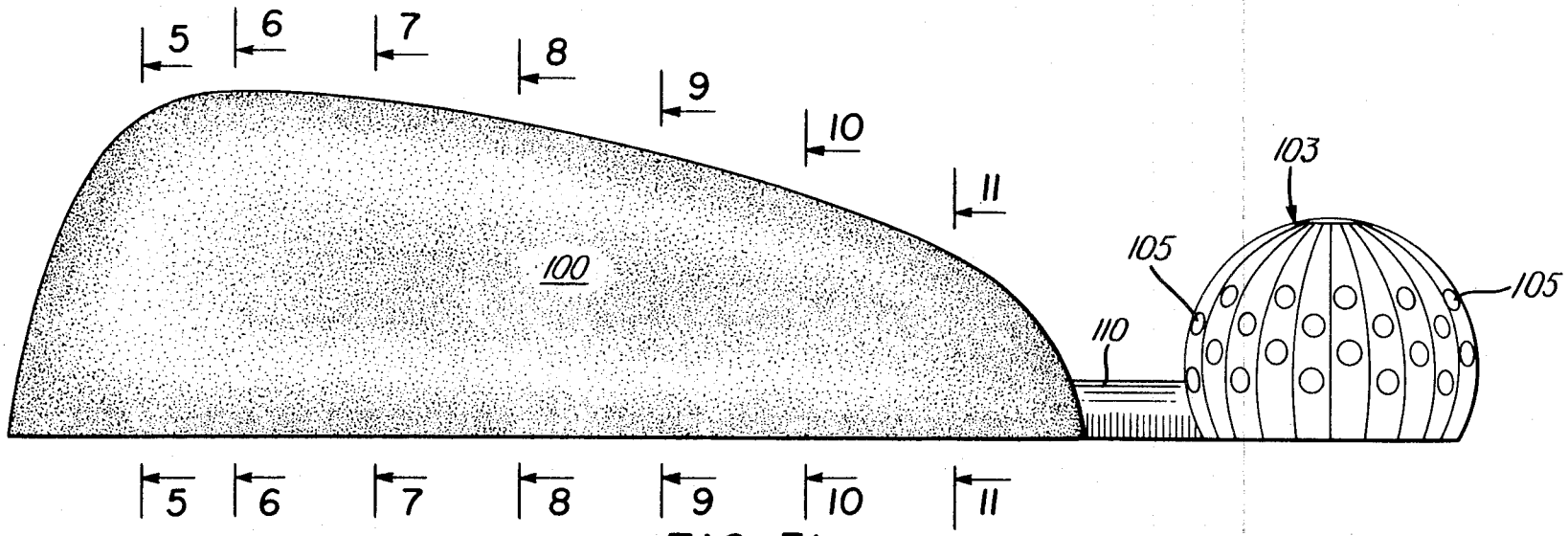
FIG. 31 is an elevation view of another embodiment of an arrangement of air-supported structures according to the invention.
Figure 32:
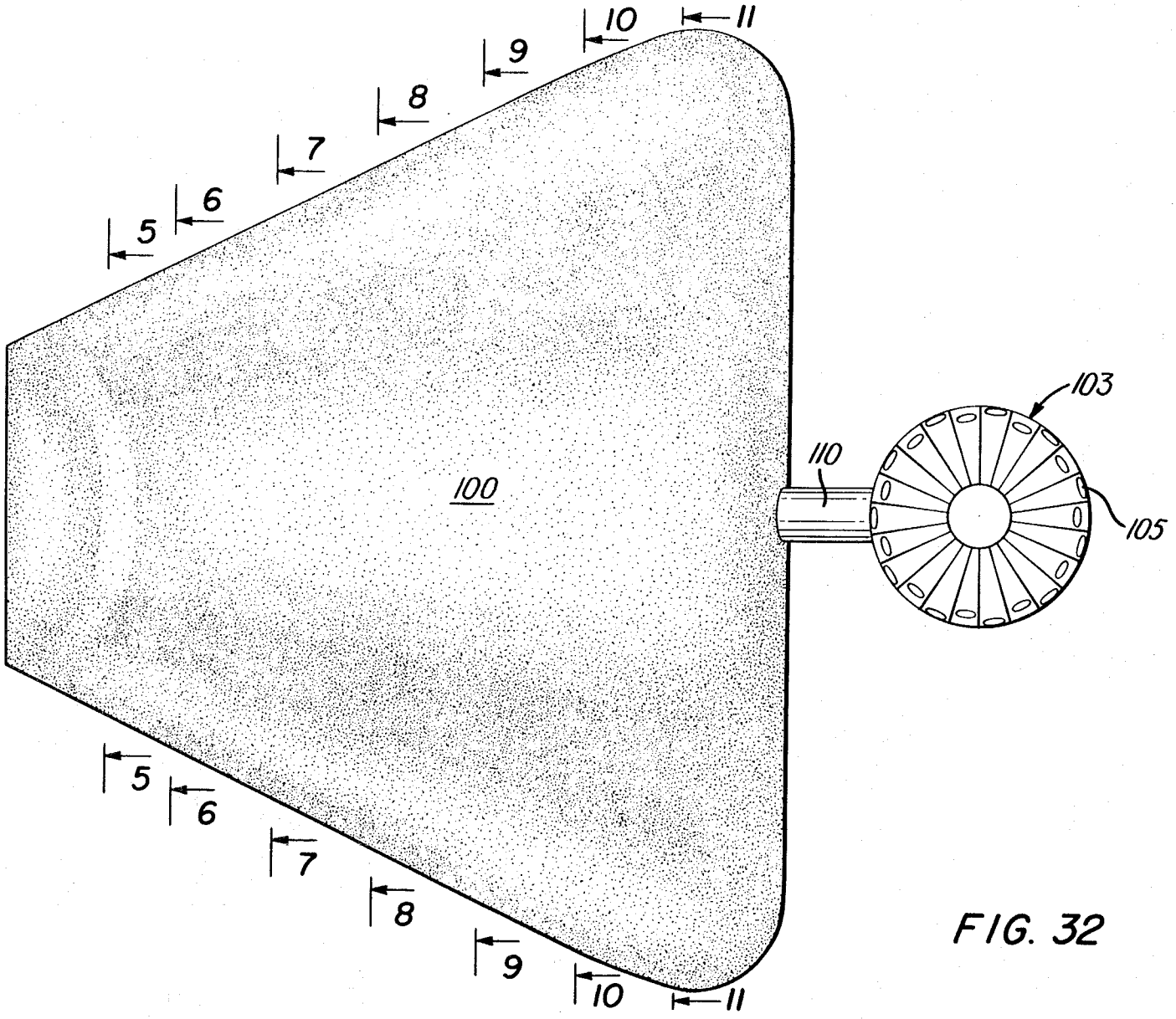
FIG. 32 is a plan view of the arrangement of the air-supported structures in FIG. 31.
Figure 33:
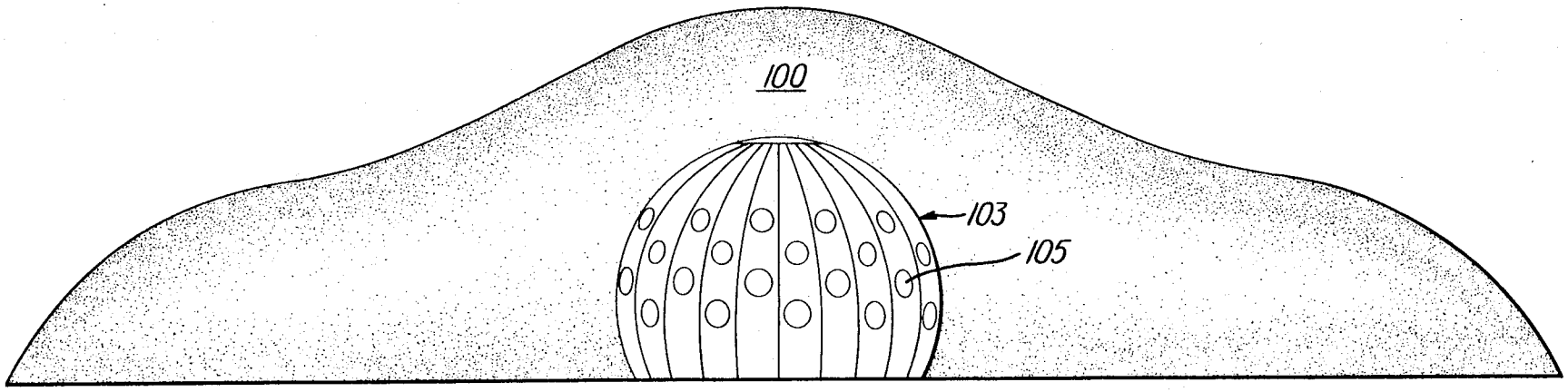
FIG. 33 is an elevation view of a front end of the arrangement of air-supported structures in FIG. 31.
Figure 34:
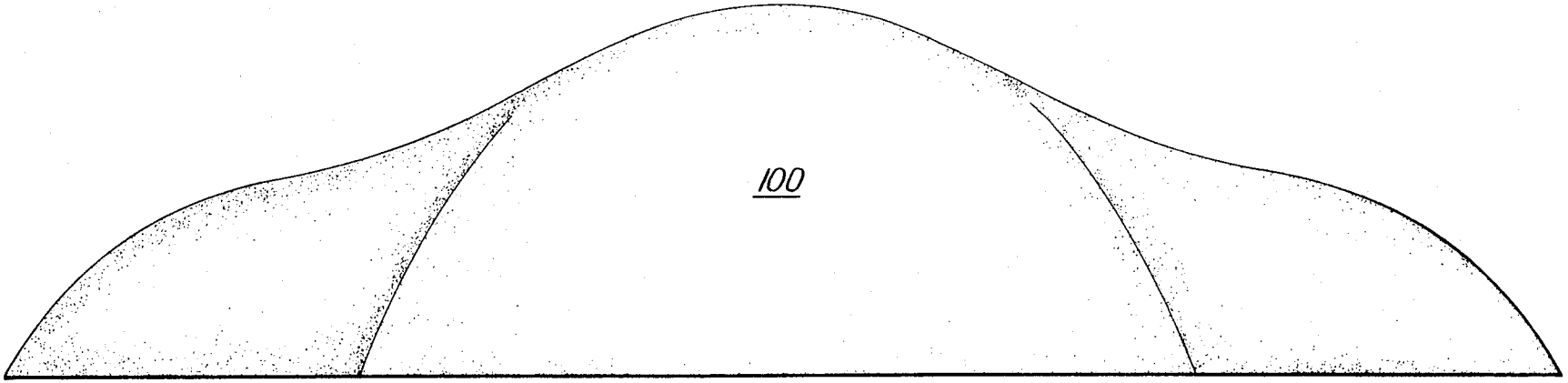
FIG. 34 is an elevation view of a rear end of the arrangement of air-supported structures in FIG. 31.

The air-supported structure 78 illustrated in FIGS. 23–26 is provided with circular "windows" made of a transparent plastic membrane bonded or otherwise secured and integral with the air-structure membrane. The "windows" 80 may be made of a clear plastic or of different colored transparent or translucent plastic that adds to the beauty of the structure. Moreover, these "windows" are at the front end of the structure and allow entry of light into the area from which the golf ball driving is taking place. As can be seen in FIGS. 24 and 25, the "windows" are of a sufficient height along the forward end of the building as to receive light from avove.

Provision is also made for club facilities in conjunction with the main or principal air-supported structure. Thus, as illustrated in FIGS. 27–30, an air-supported main or principal structure 85 is connected to a bubble-shaped additional structure 87 which is an air-supported structure made of a sheet material or membrane as before described and provided with a plurality of panels 88 having "windows" 90 thereon made of a transparent plastic material of different colors. The hemispherical air-supported structure 87 is connected to the main structure with a knock-down structure 95 which can be, for example, made of plastic panels. It can also be constructed as an air-supported structure. It is, of course, understood that the connecting passageway 95 is provided with a door and at the ends thereof, doors are provided into the air-supported structures 85 and 87 that maintain air tightness with respect to the individual air-supported structures. Of course, in this instance, the individual air-supported structures are provided with their own air-supplies or controls such as individual fans as before described and as well known in the art.

The main structure 85 is likewise provided with "windows" 96 and has a cable network 99 of the type before described. The spherical air-supported structure 87 is made sufficiently large so that it can house club facilities such as a bar and similar services.

The club facilities may be provided on any of the types of air-supported structures heretofore described for example, a main air-supported structure 100 illustrated in FIGS. 31–34 is provided with a spherical air-supported structure 103 of the "bubble" type which is likewise provided with "windows" 105. The club facilities structure 103 is connected to the main structure through a passage structure 110. The air-supported main structure is shown as not having a cable network or can have either type of network as before described.

Figure 39:
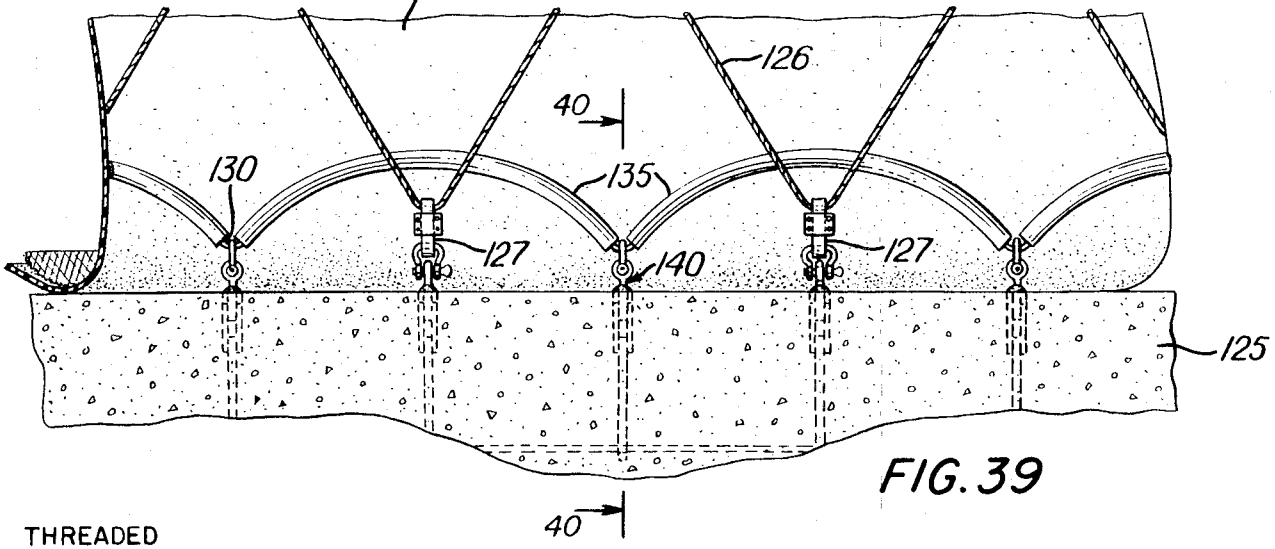
FIG. 39 is a fragmentary side elevation view of an anchor arrangement for air-supported structures according to the invention.
Figure 41:
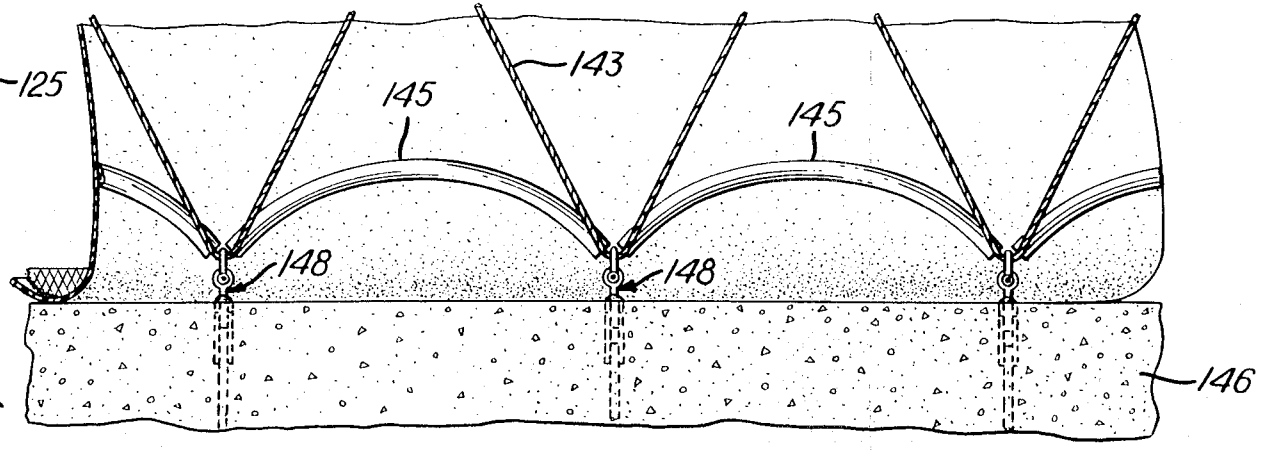
FIG. 41 is a fragmentary side elevation view of another anchor arrangement for air-supported structures according to the invention.
Figure 40:
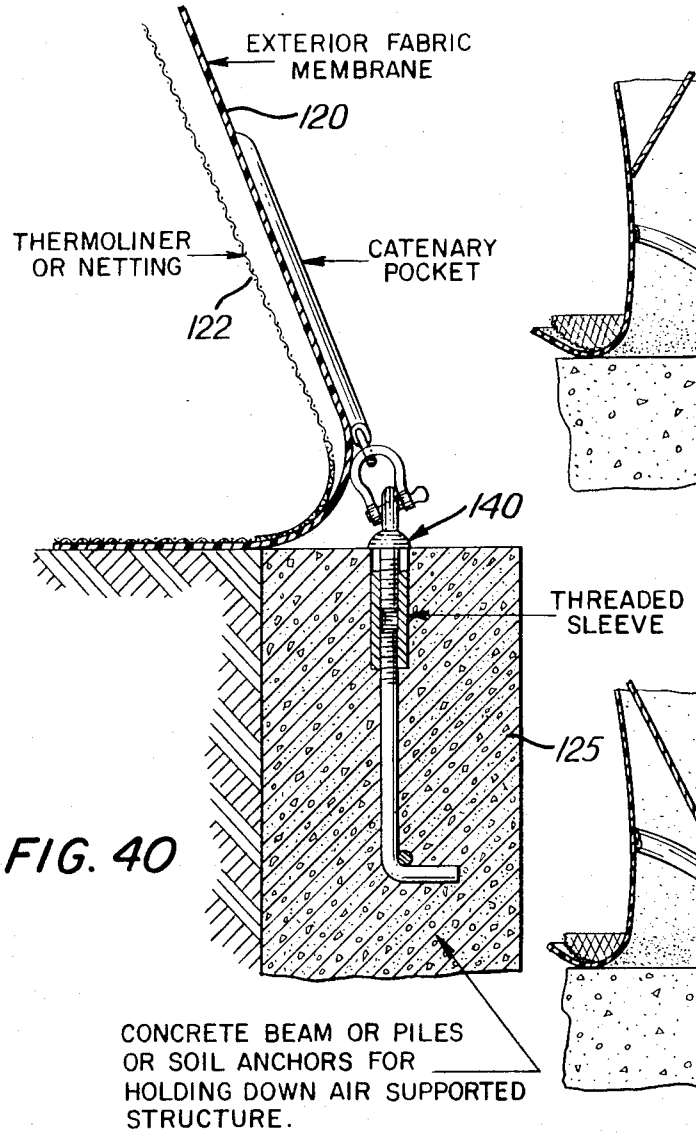
FIG. 40 is a fragmentary sectional view of the anchor arrangement to FIG. 39 taken at section line 40—40.

Other anchor arrangements are shown in FIGS. 39–41. As shown in FIGS. 39 and 40, an air-supported structure made of a weather-resistant outer or exterior membrane of a plastic fabric 120. The structure has an inner thermoliner or netting 122. The air-supported structure is anchored to a concrete base 125 by cables 126 anchored by anchors 127 as shown. Moreover, a catenary cable 130 is disposed in catenary pockets 135 secured to the outer membrane. The catenary cable is anchored by a plurality of anchors 140 embedded in the concrete base 125.

Still another anchor arrangement is shown in FIG. 41 in which cables 143 and a catenary cable in catenary pockets are anchored on a concrete base 146 by a plurality of anchors 148 common to the cables 143 and the catenary cable.

Figure 35:
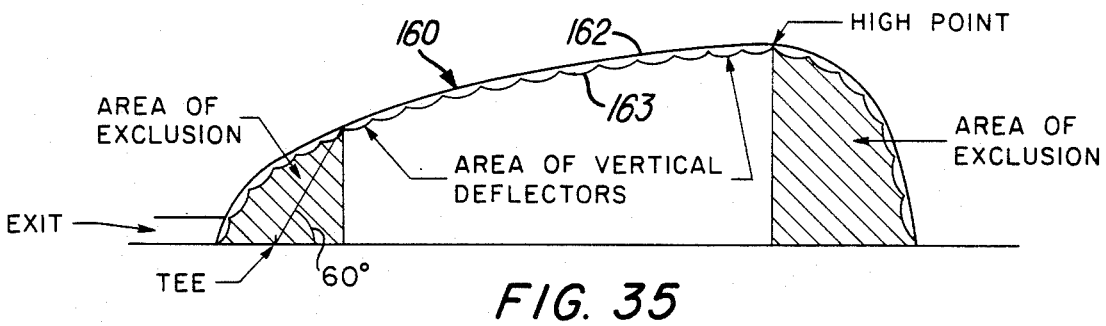
FIG. 35 is a diagrammatic elevation view of an air-supported structure for housing a golf driving range.
Figure 36:
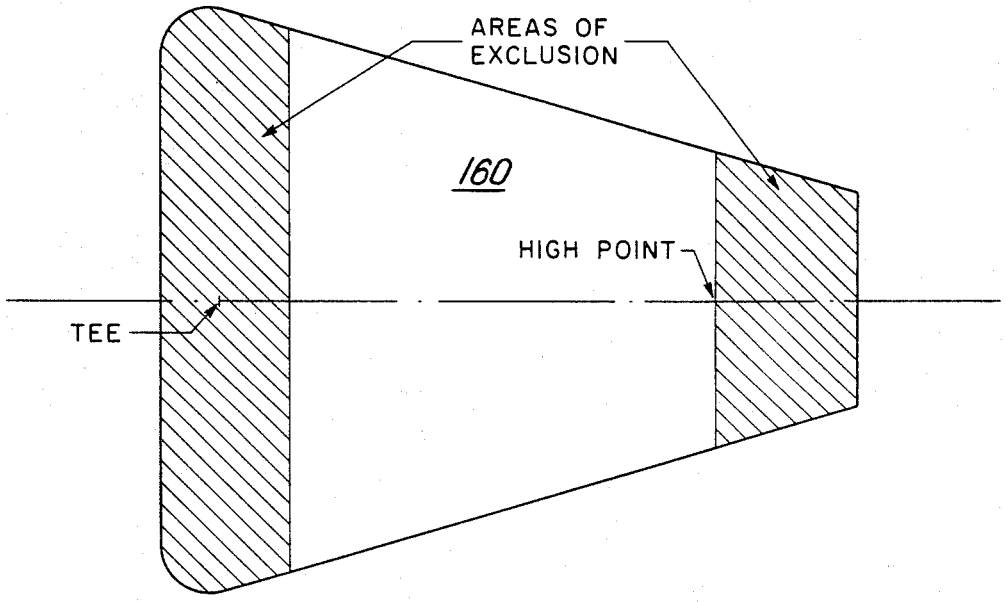
FIG. 36 is a diagrammatic plan view of the air-supported structure in FIG. 35.

The elongated main air-supported structures heretofore shown and described are particularly suitable for housing sport activities therein, for example an individual golf driving range. Provision is made according to the invention to protect the air-structures from damage by the driven golf balls. The invention provides vertical deflectors that protect the inner liner and outer skin. This is shown diagrammatically in FIGS. 35–38 inclusive. As shown in FIGS. 35 and 36, an air-supported structure 160 has an outer skin 162 and an mesh net or vinyl inner liner 163. The tee or driving position is indicated as being at ground level from which driving takes place toward the rear of the structure. Of course, the driving tees can also be disposed on an additional raised tier, not shown, above the ground level tees. The arrangement thus basically has a front and a rear area of exclusion in which the driven golf balls are not likely to impinge on the structure. The area of the structure to be protected by mesh or netting lies between the two areas of exclusion.

As shown in FIG. 36 an air-supported structure 170 has vertical deflectors 172. The vertical deflectors are disposed internally and spaced axially along the air-supported structure 170. The vertical deflectors are flexible and hang so that a straight line drawn from the center ground level tee always intersects or intercepts a vertical deflector before intercepting the inner liner and at the same time allows for the maximum trajectory of the driven golf balls. A vertical deflector 172 is disposed at the high point of the air-supported structure to define the protected area.

The vertical deflectors remove the vertical component of the path of travel of the golf balls that are driven along a path certain to cause them to strike the inner liner of the air structure. The deflectors are of sufficient downward length or have enough length of drape to intercept the golf balls along the different paths of travel, as shown, that would result in the aforementioned impinging on the liner. Thus, the vertical deflectors are axially spaced and have a downward length depending on the length and height of the individual air-supported structure. The deflectors extend transversely of the air structure in planes essentially normal to the longitudinal axis.

The vertical deflectors hang perpendicular to the ground level interiorly of the air-supported structure. They follow the lines of panel construction of the shell so that they are in vertical planes normal to a vertical plane passing through the major axis of the structure. They are dimensioned so that the bottom edge of each deflector is the same distance from the outer skin measured in a plane perpendicular to the outer skin. The spacing of the deflectors can be determined from the first deflector nearest the center tee. Since the path of travel for the driven balls has a lesser angle relative to the tee for the longer drives, the vertical deflector are spaced axially from each other a greater extent as the distance from the center tee increases as shown.

Figure 37:
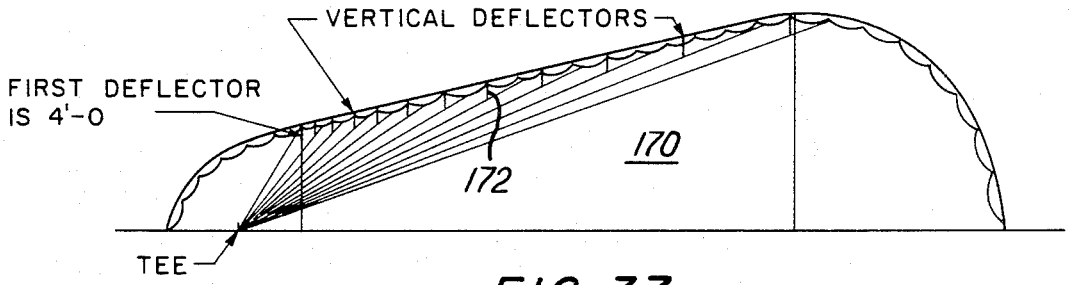
FIG. 37 is a diagrammatic elevation view of an air-supported structure for housing a golf driving range illustrating another embodiment of a protective deflector system according to the invention.
Figure 38:
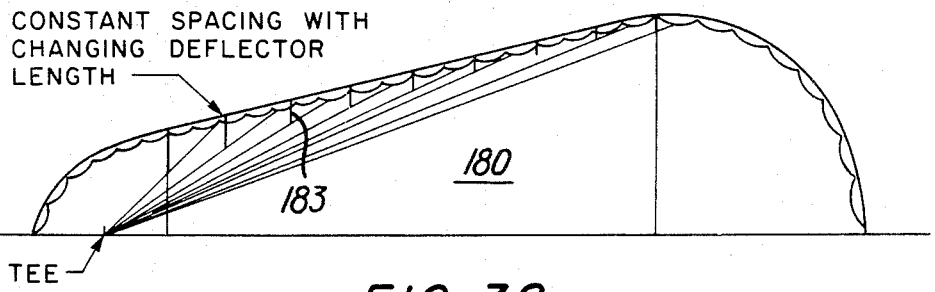
FIG. 38 is a diagrammatic elevation view of an air-supported structure for housing a golf range provided with a variation embodiment of a protective deflector system of the system in FIG. 37.

In FIG. 37 an air-supported structure 180 of the type having a protective system is illustrated as having vertical deflectors 183. In this embodiment the deflectors are of the type before described depending from the overhead surfaces of the structure 180. The vertical deflectors 183 are disposed spaced equal axial distances on the structure and are of different downward dimensions as shown. The dimensions are selected to intercept the golf balls driven through flight paths as before described, that would result on impingement on the inner liner, which is a thermoliner netting, and the outer membrane. Thus, the structure is protected and the interior space is divided into the separate areas or zones as before described.

What I claim is:

1. An air-supported structure for use in housing sport activities such as a golf-driving range and the like comprising, a flexible, collapsible and inflatable sheet mountable in an anchored condition on a surface of an area prior to inflation thereof and when inflated in an anchored condition defining an air-supported structure with arcuate surfaces, said structure having at its base periphery, the configuration of a truncated triangle, said structure being symmetrical about a vertical plane of symmetry passing through the longitudinal axis and an arcuate longitudinal profile in which a front end of the structure corresponding to a larger base of the truncated triangle is lower than a rear end of the structure at a smaller base of said truncated triangle, the top of the structure extending upwardly from the front toward the rear at an increasing pitch along the major length of the structure to a substantially highest portion of the structure and rapidly curving downwardly at the rear toward its anchor area, the structure having a transverse sectional elevation profiles with a substantially arcuate convex central area surface symmetrical about said plane of symmetry with symmetrical wing surfaces extending laterally therefrom curving downwardly away from the central portion.

2. An air-supported structure for use in housing sport activities such as a golf-driving range and the like according to claim 1, including means for anchoring peripheral edges of the structure in a substantially air-tight contact with the surface of said area on which the air-supported structure is disposed.

3. An air-supported structure for use in housing sport activities such as a golf-driving range and the like according to claim 1, including a cable or webbing network removably resting on said arcuate surfaces of said air-supported structure when inflated and means releasably anchoring the cable network.

4. An air-supported structure for use in housing sport activities such as a golf-driving range according to claim 1, in which said sheet is made of an air-impervious plastic membrane.

5. An air-supported structure for use in housing sport activities such as a golf-driving range and the like according to claim 1, including a cable or webbing strap network of radial cables overlying said structure when inflated resting on said arcuate surfaces of said air-supported structure when the structure is in an inflated condition, said radial cables being spaced axially along the longitudinal length of said structure, and means releasably anchoring the cables independently of each other.

6. An air-supported structure for use in housing sport activities such as a golf-driving range and the like according to claim 1, including a cable or webbing strap network overlying said structure resting on said arcuate surfaces of said air-supported structure when the structure is in an inflated condition, said cables or webbing straps intersecting at various angles, and means releasably anchoring the cables.

7. An air-supported structure for use in housing sport activities such as a golf-driving range and the like according to claim 6, including means joining intersecting cables or webbing straps at individual points of intersection.

8. An air-supported structure for use in housing sport activities such as a golf-driving range and the like according to claim 1, including a bubble-shaped air-supported structure comprising a second flexible, collapsible and inflatable sheet defining when mounted and in an inflated condition a bubble configuration, and means providing a passageway between the first mentioned structure and said bubble-shaped structure and joining them.

9. An air-supported structure for use in housing sport activities such as a golf-driving range and the like according to claim 8, in which said bubble-shaped structure is made of a plastic sheet and in which said sheet has areas of transparent plastic.

10. An air-supported structure for use in housing sport activities such as a golf-driving range and the like according to claim 8, in which the remainder of said plastic sheet is not transparent and is translucent.

11. An air-supported structure for use in housing sport activities such as a golf-driving range and the like according to claim 1, in which said sheet is made of a translucent plastic material.

12. An air-supported structure for use in housing sport activities such as a golf-driving range and the like according to claim 11, in which said sheet includes areas thereof made of a transparent plastic.

13. In combination, a first air-supported structure for use in housing sport activities such as a golf-driving range and the like comprising a flexible, collapsible and inflatable sheet mountable in an anchored condition on a surface of an area prior to inflation thereof and when inflated in an anchored condition defining an air-supported structure with arcuate surfaces, said structure having at its base, a periphery substantially defining a truncated triangle, said structure being symmetrical about a vertical plane of symmetry passing through a longitudinal axis of said structure and an arcuate longitudinal profile in which a front end of the structure corresponding to portion of the structure adjacent a larger base of the truncated triangle is lower than a rear end portion corresponding to a portion of the structure adjacent a smaller base of the truncated triangle, the top of the structure extending upwardly from the front toward the rear at an increasing pitch along the major length of the structure to a substantially highest portion of the structure and rapidly curving downwardly at the rear toward its anchor area, the structure having transverse sectional profiles with a substantially arcuate convex central area surface symmetrical about said plane of symmetry with symmetrical wing surfaces extending laterally therefrom curving downwardly from the central portion, means anchoring the sheet in a substantially air-tight manner to said surface of said area, a second air-supported structure disposed forwardly of the first air-supported structure and spaced therefrom, means defining a passageway between the first and second air-supported structures, and the second air-supported structure having a bubble-shaped configuration.

14. The combination according to claim 13, in which said means defining the passageway comprises an air-supported structure.

15. The combination according to claim 14, in which said second air-supported structure comprises a membrane of a substantially air-impervious material.

16. The combination according to claim 13, in which said means defining said passageway comprises a knock-down tunnel made of plastic sections.

17. An air-supported structure for use in housing sport activities such as a golf-driving range and the like comprising, a flexible, collapsible and inflatable membrane mountable on a surface of an area prior to inflation thereof and when inflated in said anchored condition defining an air-supported structure with arcuate surfaces, said structure being symmetrical about a vertical plane of symmetry passing through a longitudinal axis of the structure, deflector means for deflecting driven golf balls from impinging on interior overhead surfaces of the structure comprising, a plurality of hanging flexible deflectors disposed transversely of the structure and hanging in planes normal to said vertical plane, and said deflectors being disposed spaced axially of the structure supported from overhead surfaces of the structure.

18. An air-supported structure for use in housing apart activities such as a golf-driving range and the like according to claim 17, in which said deflectors extend downwardly an equal length, and the air-supported structure has a side elevation profile in which a front end portion of the structure is lower than a rear end portion of the structure.

19. An air-supported structure for use in housing sport activities such as a golf-driving range and the like according to claim 17, in which the air-supported structure has a side elevation profile in which a front end portion of the structure is lower than a rear end portion of the structure, and in which the deflectors extend downwardly an equal length and are spaced axially equal distances.

20. An air-supported structure for use in housing sport activities such as a golf-driving range and the like according to claim 17, including a network of cables or webbing straps overlying the air structure, and means to anchor the network of cables.

* * * * *